US008712302B2

(12) United States Patent
Nakamura et al.

(10) Patent No.: US 8,712,302 B2
(45) Date of Patent: Apr. 29, 2014

(54) PRESSURE-APPLYING MEMBER, FIXING DEVICE, AND IMAGE FORMING APPARATUS

(75) Inventors: Tahei Nakamura, Hyogo (JP); Koji Okabe, Kanagawa (JP); Yuki Kubota, Kanagawa (JP); Yasutaka Gotoh, Kanagawa (JP); Hiroko Furukata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 326 days.

(21) Appl. No.: 13/298,074

(22) Filed: Nov. 16, 2011

(65) Prior Publication Data

US 2012/0251206 A1 Oct. 4, 2012

(30) Foreign Application Priority Data

Mar. 29, 2011 (JP) ..... 2011-073637

(51) Int. Cl.
*G03G 15/20* (2006.01)

(52) U.S. Cl.
USPC ..... 399/329; 399/122

(58) Field of Classification Search
USPC ..... 399/107, 110, 122, 320, 328, 329
See application file for complete search history.

(56) References Cited

U.S. PATENT DOCUMENTS

| | | | | |
|---|---|---|---|---|
| 5,999,788 | A | 12/1999 | Kanesawa et al. | |
| 7,200,345 | B2 | 4/2007 | Katayanagi et al. | |
| 7,773,930 | B2 * | 8/2010 | Shin et al. | 399/329 |
| 8,311,469 | B2 * | 11/2012 | Yoshikawa et al. | 399/329 |
| 2002/0061211 | A1 | 5/2002 | Kamijo et al. | |
| 2005/0191071 | A1 | 9/2005 | Katayanagi et al. | |

FOREIGN PATENT DOCUMENTS

| | | | |
|---|---|---|---|
| JP | 04-055056 | A | 2/1992 |
| JP | 11-133776 | A | 5/1999 |
| JP | 2002-082551 | A | 3/2002 |
| JP | 2002-148972 | A | 5/2002 |
| JP | 2002-148981 | A | 5/2002 |
| JP | 2002-148984 | A | 5/2002 |
| JP | 3285658 | B2 | 5/2002 |
| JP | 2005-241954 | A | 9/2005 |
| JP | 2008-065044 | A | 3/2008 |
| JP | 2009-217159 | A | 9/2009 |
| JP | 4706726 | B2 | 6/2011 |

OTHER PUBLICATIONS

Japanese Office Action issued Apr. 2, 2013 in corresponding Japanese Patent Application No. 2011-073637.

* cited by examiner

*Primary Examiner* — Hoan Tran
(74) *Attorney, Agent, or Firm* — Sughrue Mion, PLLC

(57) ABSTRACT

A fixing device includes a rotatable heating member including a heat source and a pressure-applying member pressed against the heating member. The pressure-applying member includes a band-shaped member that extends in a width direction of a medium that passes through a fixing area, a support member opposed to the heating member with the band-shaped member disposed therebetween, and a pressing member including a base-end portion supported by the support member and a free-end portion that extends toward the fixing area. The pressing member has urging portions arranged with intervals therebetween in the width direction. The urging portions are elastically deformable in accordance with a thickness of the medium when the medium passes through the fixing area. The free-end portion urges the band-shaped member toward the heating member so that the band-shaped member is pressed against the heating member.

15 Claims, 16 Drawing Sheets

PRESSURE-APPLYING MEMBER, FIXING DEVICE, AND IMAGE FORMING APPARATUS

CROSS-REFERENCE TO RELATED APPLICATIONS

This application is based on and claims priority under 35 USC 119 from Japanese Patent Application No. 2011-073637 filed Mar. 29, 2011.

BACKGROUND

The present invention relates to a pressure-applying member, a fixing device, and an image forming apparatus.

SUMMARY

According to an aspect of the invention, there is provided a fixing device including a heating member that is rotatably supported and includes a heat source at an inner section of the heating member and a pressure-applying member that is pressed against the heating member. The pressure-applying member includes a band-shaped member that extends in a width direction of a medium that passes through a fixing area in which the band-shaped member faces the heating member, a support member that is opposed to the heating member with the band-shaped member disposed between the support member and the heating member, and a pressing member including a base-end portion that is supported by the support member and a free-end portion that extends toward the fixing area. The pressing member has plural urging portions arranged with intervals therebetween in the width direction, the urging portions being elastically deformable in accordance with a thickness of the medium when the medium passes through the fixing area, the free-end portion urging the band-shaped member in an urging direction, which is toward the heating member, so that the band-shaped member is pressed against the heating member.

BRIEF DESCRIPTION OF THE DRAWINGS

Exemplary embodiments of the present invention will be described in detail based on the following figures, wherein:

FIGS. 7A and 7B are diagrams illustrating plates and rotating levers supported on the inner surfaces of the plates, wherein FIG. 7A is a plan view of the plates and the rotating levers and FIG. 7B is an enlarged perspective view of the rotating levers;

FIGS. 8A and 8B are diagrams illustrating a leaf spring of the first exemplary embodiment, wherein FIG. 8A is an enlarged perspective view of the leaf spring and FIG. 8B illustrates a base-end portion of the leaf spring supported on a base as viewed in the direction from left to right;

FIGS. 10A and 10B are diagrams illustrating a part of the fixing device according to the second exemplary embodiment, wherein FIG. 10A illustrates the state in which a belt member, end-attachment members, fins, an oil-impregnated felt, and a sliding sheet are removed from the state illustrated in FIG. 9, and FIG. 10B illustrates the state in which the end-attachment members and the fins are attached, as viewed in the direction shown by arrow XB in FIG. 10A;

FIGS. 12A to 12D are diagrams illustrating the state of the fixing device when operation levers according to the second exemplary embodiment are moved between a job operation position and a jam recovery operation position, wherein FIG. 12A illustrates the state of the fixing device when the operation levers are moved to the job operation position as viewed in the direction from front to back of a front plate, FIG. 12B illustrates the state of FIG. 12A in a sectional view taken along line XIIB-XIIB in FIG. 10B as viewed in the direction from front to back, FIG. 12C illustrates the state of the fixing device when the operation levers are moved to the jam recovery operation position as viewed in the direction from front to back of the front plate, and FIG. 12D illustrates the state of FIG. 12A in a sectional view taken along line XIID-XIID in FIG. 10B as viewed in the direction from front to back.

FIGS. 15A and 15B are diagrams illustrating a leaf spring according to a fifth exemplary embodiment, wherein FIG. 15A is an enlarged perspective view of the leaf spring that corresponds to FIG. 8A illustrating the first exemplary embodiment and FIG. 15B is a sectional view of FIG. 15A taken along line XVB-XVB;

FIGS. 16A to 16C are diagrams illustrating a pressing member according to a sixth exemplary embodiment, wherein FIG. 16A is an enlarged perspective view of the pressing member according to the sixth exemplary embodiment that corresponds to FIG. 8A illustrating the first exemplary embodiment, FIG. 16B is an enlarged perspective view of a flat plate portion as viewed in the direction shown by arrow XVIB in FIG. 16A, and FIG. 16C is a sectional view of FIG. 16A taken along line XVIC-XVIC; and FIGS. 17A and 17B are diagrams illustrating a base according to a modification, wherein FIG. 17A is an enlarged perspective view of the base according to the modification and FIG. 17B illustrates the base according to the modification as viewed in the direction shown by arrow XVIIB in FIG. 17A.

DETAILED DESCRIPTION

Exemplary embodiments of the present invention will be described with reference to the drawings. However, the present invention is not limited to the following exemplary embodiments.

To facilitate understanding of the following descriptions, the front-back direction, the left-right direction, and the up-down direction are defined as the X-axis direction, the Y-axis direction, and the Z-axis direction, respectively, in each figure. In addition, directions shown by arrows X, −X, Y, −Y, Z, and −Z are defined as forward, backward, rightward, leftward, upward, and downward, respectively, and sides in those directions are defined as the front side, the back side, the right side, the left side, the top side, and the bottom side, respectively.

In the figures, circles having dots at the center show the direction from back to front with respect to the sides illustrated in the figures, and circles having the "x" marks therein show the direction from front to back with respect to the sides illustrated in the figures.

In each figure, components other than those necessary for the explanations are omitted to facilitate understanding.

First Exemplary Embodiment

Figure 1:
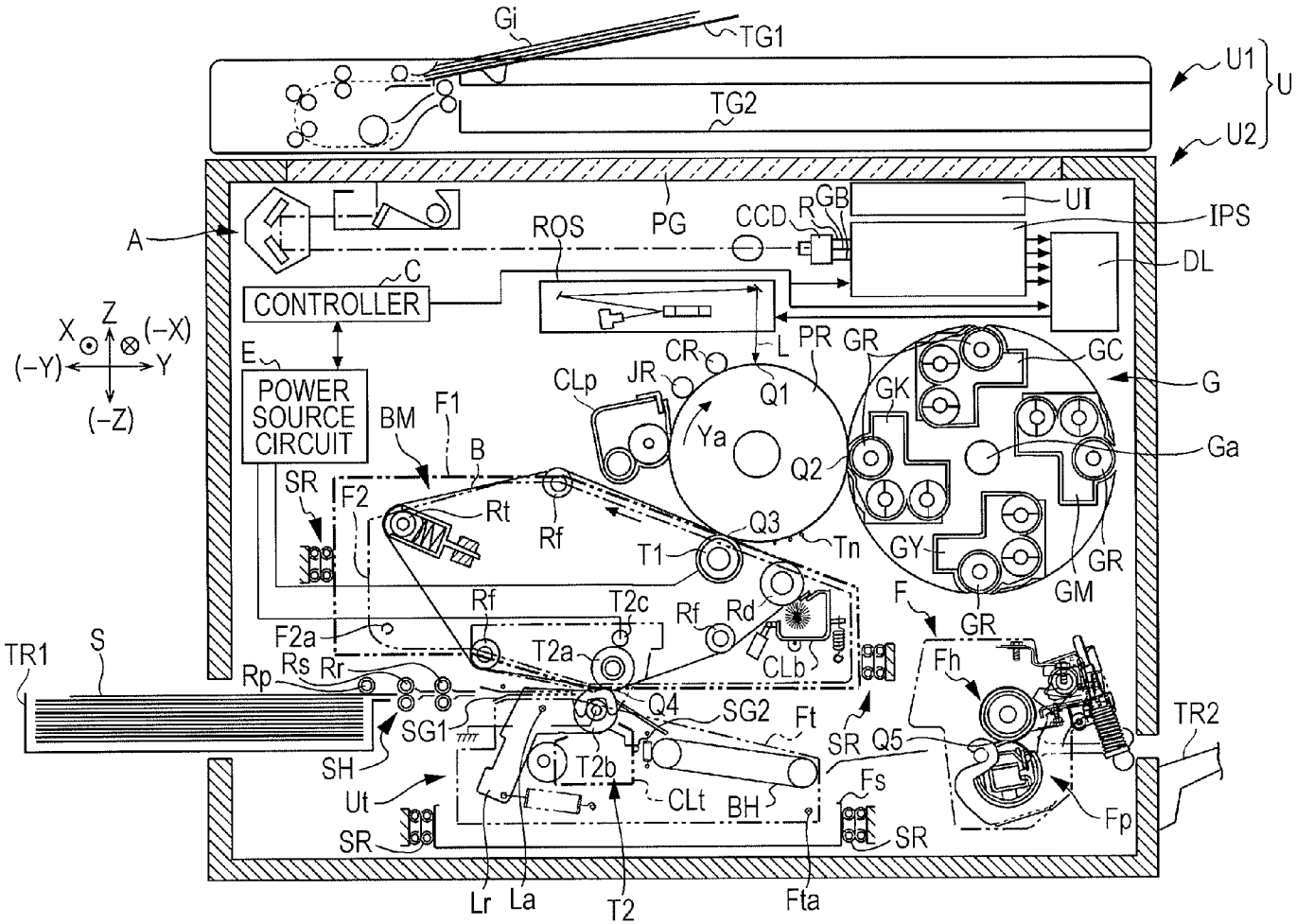
FIG. 1 is a diagram illustrating an image forming apparatus including a fixing device according to a first exemplary embodiment.

FIG. 1 is a diagram illustrating an image forming apparatus U including a fixing device F according to a first exemplary embodiment.

Referring to FIG. 1, the image forming apparatus U includes a document transporting device U1 and an image-forming-apparatus body U2, which is an example of a copy machine. The image-forming-apparatus body U2 supports the document transporting device U1 and includes a platen glass PG, which is an example of a document base. The document transporting device U1 includes a document feed tray TG1, which is an example of a document receiving section, and a document output tray TG2, which is an example of a document output section. Plural sheets of document Gi of which a copy is to be made are placed on the document feed tray TG1. The sheets of document Gi are transported through a copy position, which is an example of a document read position, on the platen glass PG and are ejected onto the document output tray TG2. The image-forming-apparatus body U2 includes a user interface UI, an exposure optical system A, and other components. The user interface UI is an example of an operation unit which is operated by a user to input a signal representing an operation command, such as a print start command, that is, a copy start command. Reflected light reflected by a sheet of document that is transported along the platen glass PG or manually placed on the platen glass PG in the document transporting device U1 is guided to the exposure optical system A, and is converted into red (R), green (G), and blue (B) electric signals by solid-state image pickup devices CCD. An image processing section IPS converts the R, G, and B electric signals into yellow (Y), magenta (M), cyan (C), and black (K) image data and temporarily stores the image data. Then, the image processing section IPS outputs the image data to a laser driving circuit DL at a predetermined timing.

A surface of an image carrier PR that rotates in the direction shown by arrow Ya is uniformly charged by a charging roller CR, which is an example of a charging member, and successively passes through a latent-image write position Q1, a developing area Q2, and a first transfer area Q3. A latent-image writing device ROS, which is driven by the laser driving circuit DL, scans the surface of the image carrier PR with a laser beam L, which is an example of write light, at the latent-image write position Q1, and thereby forms an electrostatic latent image on the surface of the image carrier PR. In the case of forming a multicolor image, that is, a so-called full-color image, latent images corresponding to images of four colors, which are yellow (Y), magenta (M), cyan (C), and black (K), are successively formed. In the case of forming a monochrome image, only an electrostatic latent image corresponding to a black (K) image is formed.

A rotary developing device G includes four developing units GY, GM, GC, and GK of the respective colors, which are yellow (Y), magenta (M), cyan (C), and black (K). The developing units GY, GM, GC, and GK are successively rotated to the above-described developing area Q2 in response to a rotation of a rotating shaft Ga. Each of the developing units GY, GM, GC, and GK includes a developing roller GR, which is an example of a developer carrier that transports developer to the developing area Q2, and develops the electrostatic latent image on the image carrier PR that passes through the developing area Q2 into a toner image Tn, which is an example of a visualized image.

A slide frame F1, which is shown by the two-dot chain lines, is supported by left and right slide rails SR, which are examples of frame guide units, in an area below the image carrier PR such that the slide frame F1 is slidable in the front-back direction. The slide frame F1 is an example of a movable frame. A belt frame F2 is supported by the slide frame F1 such that the belt frame F2 is rotatable in the up-down direction around a hinge shaft F2*a*. The belt frame F2 is an example of a frame member for a band-shaped member included in a belt module BM, which is an example of an intermediate transfer device. The hinge shaft F2*a* is an example of a shaft member for the frame member. The belt module BM includes belt support rollers Rd, Rt, Rf, and T2*a*, which are examples of plural support members for the band-shaped member, a first transfer roller T1, which is an example of a first transfer member, a contact roller T2*c*, which is an example of a second transfer contact member, and the belt frame F2 that supports the above-mentioned components. The belt support rollers Rd, Rt, Rf, and T2*a* support an intermediate transfer belt B, which is an example of the band-shaped member and is also an example of an intermediate transfer member. The belt support rollers Rd, Rt, Rf, and T2*a* include a belt driving roller Rd, which is an example of a driving member for the band-shaped member, a tension roller Rt, which is an example of a tension-applying member for the band-shaped member, idler rollers Rf, which are examples of driven members for the band-shaped member, and a backup roller T2*a*, which is an example of a second transfer counter member. The contact roller T2*c* is in contact with the backup roller T2*a*.

The belt module BM is rotatable in the up-down direction around the hinge shaft F2*a*. When the belt module BM is rotated downward, the belt module BM may be inserted into and taken out from the image-forming-apparatus body U2 together with the slide frame F1 without coming into frictional contact with the image carrier PR. A power source circuit E controlled by a controller C, which is an example of a control unit, applies a transfer voltage with a polarity opposite to the charging polarity of toner, which is an example of developer, to the first transfer roller T1. Accordingly, a first transfer process is performed in which the toner image Tn on the surface of the image carrier PR is transferred onto the intermediate transfer belt B in the first transfer area Q3. In the case of forming a full-color image, the first transfer process is performed such that toner images Tn of the respective colors are successively formed on the surface of the image carrier PR and are successively transferred onto the surface of the intermediate transfer belt B in a superimposed manner in the first transfer area Q3. Thus, full-color toner images are formed on the intermediate transfer belt B in a superimposed manner. In the case of forming a monochrome image, only one developing unit GK is used and a monochrome toner image is transferred onto the intermediate transfer belt B in the first transfer process. After the first transfer process, an image-carrier cleaner CLp, which is an example of a cleaning member for the image carrier, cleans the surface of the image carrier PR by removing the residual toner, and a charge-eliminating roller JR, which is an example of a charge-eliminating member, eliminates the electric charge on the surface of the image carrier PR.

A second transfer slide frame Fs, which is an example of a second-transfer movable frame, is supported at a position below the backup roller T2*a* such that the second transfer slide frame Fs is detachable from the image-forming-apparatus body U2. The second transfer slide frame Fs is slidable in the front-back direction along left and right slide rails SR. A second transfer raising-and-lowering frame Ft is supported by the second transfer slide frame Fs such that the second transfer raising-and-lowering frame Ft is rotatable in the up-down direction around a hinge shaft Fta. The second transfer raising-and-lowering frame Ft is an example of a second-transfer raising-and-lowering member for a second transfer unit Ut, and the hinge shaft Fta is an example of a shaft member for the raising-and-lowering member. When the second transfer unit Ut is rotated downward, the second transfer unit Ut may be inserted into and taken out from the image-forming-apparatus body U2 without coming into, frictional contact with the belt module BM. The second transfer unit Ut includes a second transfer roller T2*b*, which is an example of a second transfer member, a second-transfer-roller cleaner CLt, which is an example of a cleaning member for the second transfer member, a roller support lever Lr, which is an example of a support member for the second transfer member, a post-transfer sheet guide SG2, which is an example of a post-transfer guiding member, a sheet transporting belt BH, which is an example of a band-shaped member for transporting a medium, and the second transfer raising-and-lowering frame Ft that supports the above-mentioned components.

The roller support lever Lr supports the second transfer roller T2*b* and the second-transfer-roller cleaner CLt, and is rotated around a hinge shaft La, which is an example of a shaft member for the support member, by a motor (not shown), which is an example of a drive unit for the support member. Thus, the roller support lever Lr moves the second transfer roller T2*b* between a second transfer position at which the second transfer roller T2*b* comes into contact with the intermediate transfer belt B and a standby position at which the second transfer roller T2*b* is separated from the intermediate transfer belt B. A second transfer area Q4 is defined by a contact area between the second transfer roller T2*b* and the intermediate transfer belt B. The second transfer roller T2*b*, the backup roller T2*a*, and the contact roller T2*c* form a second transfer member T2.

The first transfer roller T1, the intermediate transfer belt B, the second transfer member T2, etc., form a transfer device T1+B+T2 according to the first exemplary embodiment.

Sheets S, which are examples of media, are stored in a paper feed tray TR1, which is an example of a medium supplying member. The sheets S are picked up by a pickup roller Rp, which is an example of a pickup member, at a predetermined timing, and are separated from each other by separation rollers Rs, which are examples of separation members. Then, each sheet S is transported to registration rollers Rr, which are examples of timing-adjusting members. The sheet S that has been transported to the registration rollers Rr is transported from a pre-transfer sheet guide SG1, which is an example of a pre-transfer guiding member, to the second transfer area Q4 in synchronization with the movement of the full-color toner images or the monochrome toner image to the second transfer area Q4 after the first transfer process. When the sheet S passes through the second transfer area Q4, the power source circuit E controlled by the controller C applies a second transfer voltage with the same polarity as the charging polarity of the toner to the contact roller T2*c* included in the second transfer member T2. The second transfer member T2 performs a second transfer process in which the color toner images, which have been transferred onto the intermediate transfer belt B in a superimposed manner in the first transfer process, are simultaneously transferred onto the sheet S in the second transfer area Q4. After the second transfer process, a belt cleaner CLb, which is an example of a cleaning member for the band-shaped member, removes the residual toner that remains on the intermediate transfer belt B. In addition, a second-transfer-roller cleaner CLt collects the toner that adheres to the surface of the second transfer roller T2*b*.

The second transfer roller T2*b* and the belt cleaner CLb are arranged such that they are capable of coming into contact with and moving away from the intermediate transfer belt B. In the case of forming a color image, the second transfer roller T2*b* and the belt cleaner CLb are separated from the intermediate transfer belt B until the unfixed toner image of the last color is transferred onto the intermediate transfer belt B. The second-transfer-roller cleaner CLt is moved toward and away from the intermediate transfer belt B together with the second transfer roller T2*b*. The sheet S onto which the toner images have been transferred in the second transfer process is transported to a fixing area Q5 by the post-transfer sheet guide SG2 and the sheet transporting belt BH. The fixing area Q5 is defined by a contact area between a heating roller Fh, which is an example of a heating member, and a pressure-applying belt Fp, which is an example of a pressure-applying member. The sheet S is subjected to a heat-fixing process by a fixing device F, which includes the heating roller Fh and the pressure-applying belt Fp, when the sheet S passes through the fixing area Q5. The sheet S to which the toner images are fixed is ejected onto a sheet output tray TR2, which is an example of a medium output member. The above-described components denoted by Rp, Rs, Rr, SG1, SG2, and BH form a sheet transporting device SH, which is an example of a medium transporting device.

Description of Fixing Device F of First Exemplary Embodiment

Figure 2:
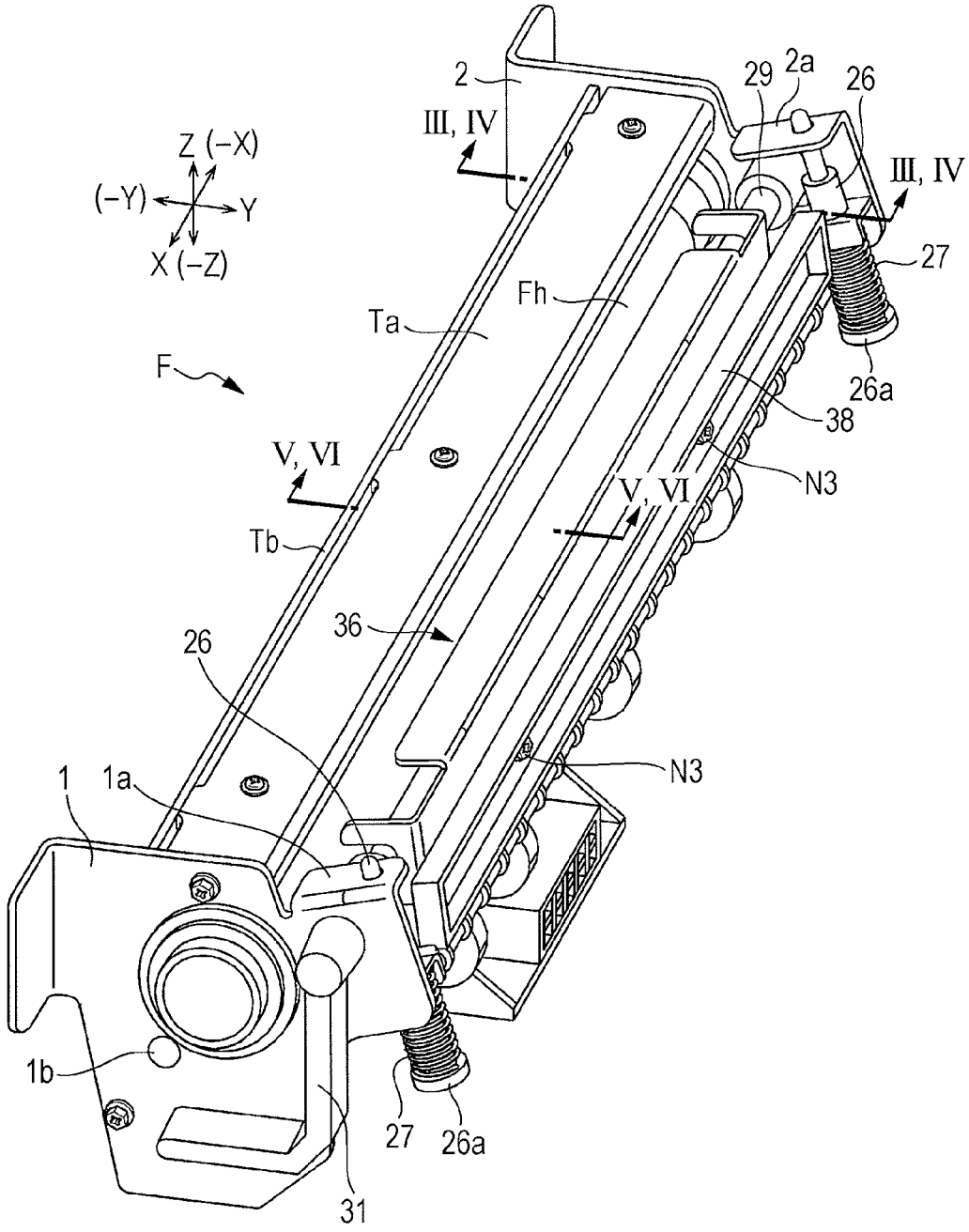
FIG. 2 is a perspective view illustrating the overall structure of the fixing device illustrated in FIG. 1.

FIG. 2 is a perspective view illustrating the overall structure of the fixing device F illustrated in FIG. 1.

Figure 3:
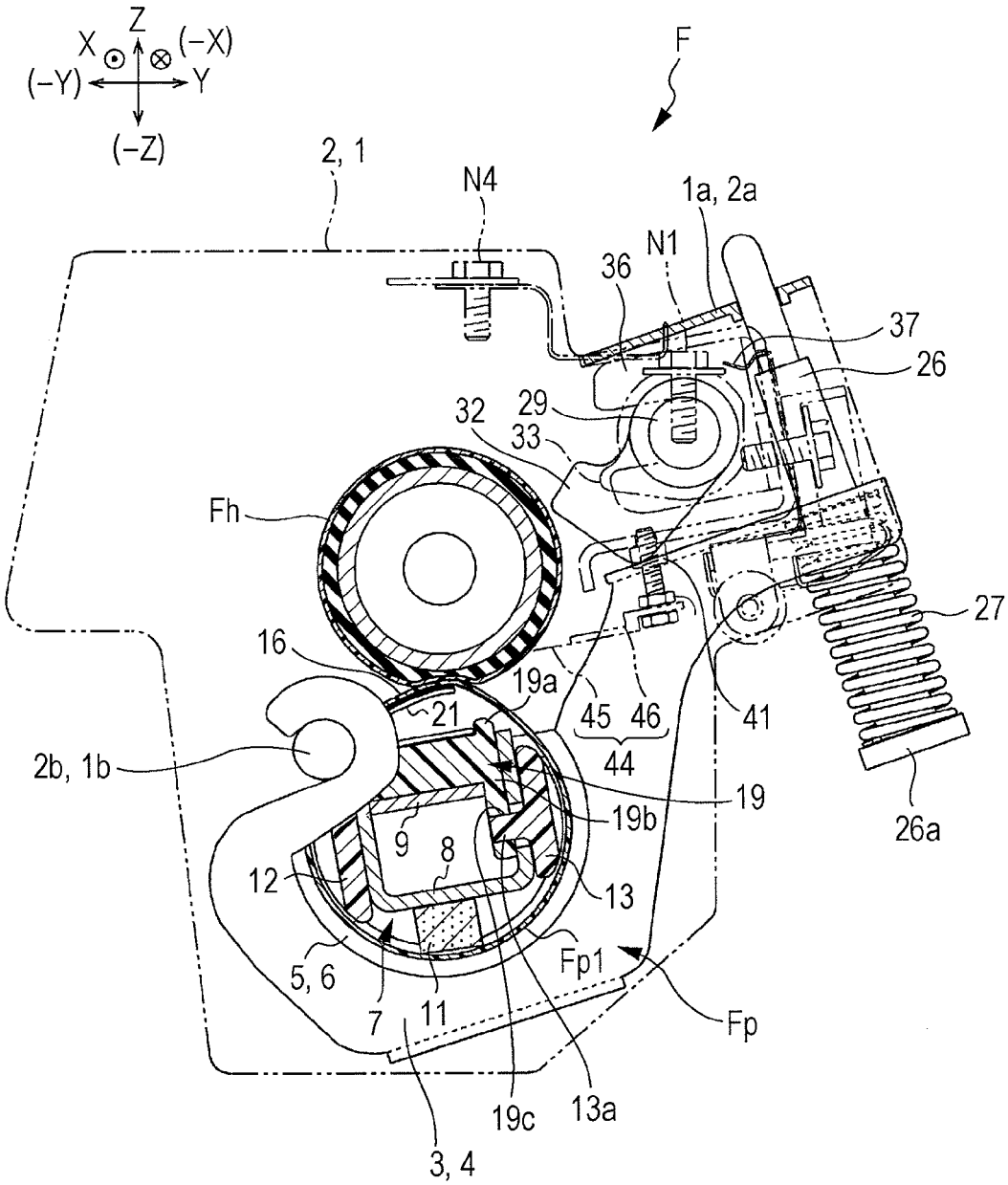
FIG. 3 is a sectional view of a part of FIG. 2 taken along line III-III, illustrating the state in which a pressure-applying belt is in contact with a heating roller.

FIG. 3 is a sectional view of a part of FIG. 2 taken along line III-III, illustrating the state in which the pressure-applying belt Fp is in contact with the heating roller Fh.

Figure 4:
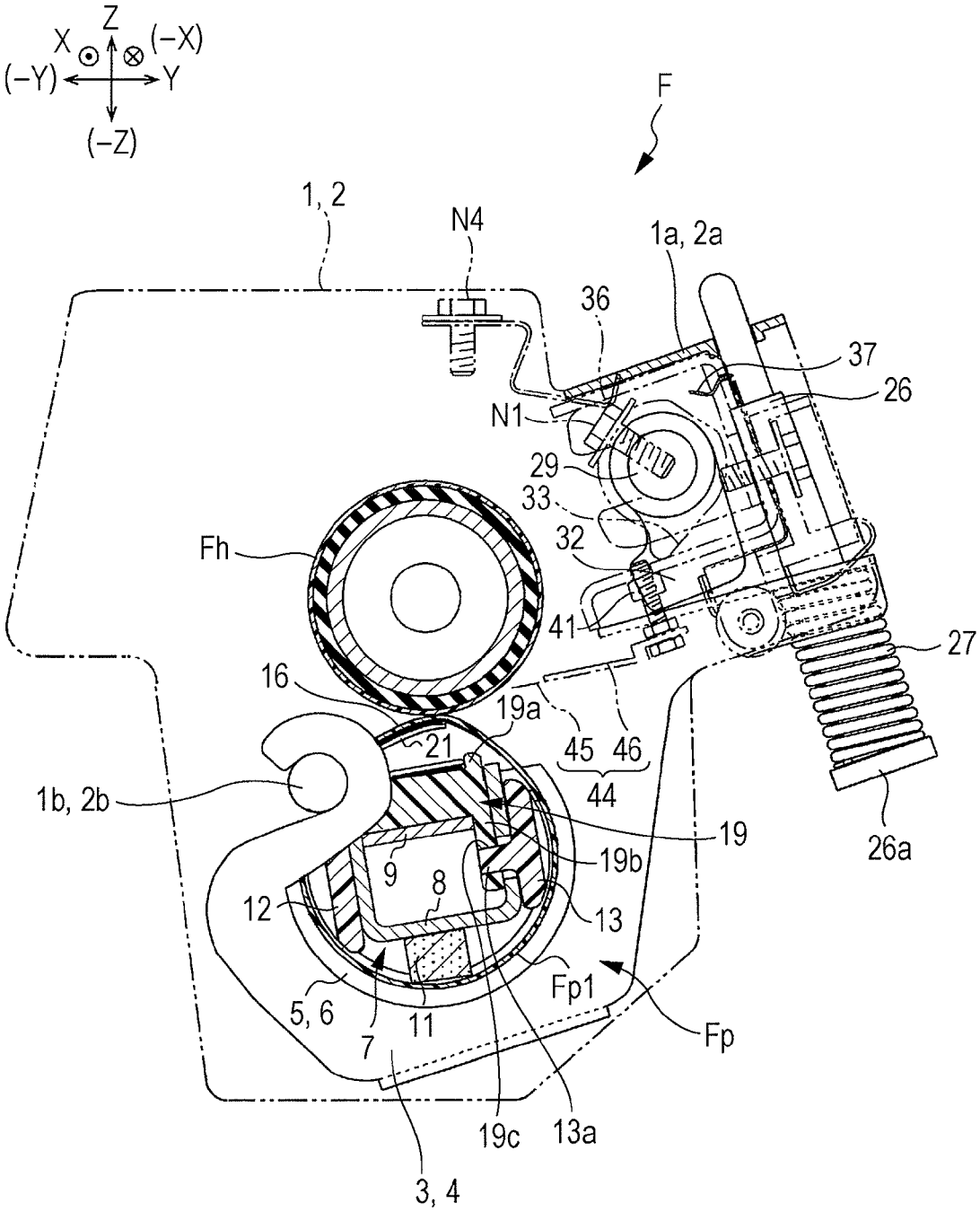
FIG. 4 is a sectional view of a part of FIG. 2 taken along line IV-IV, illustrating the state in which the pressure-applying belt is separated from the heating roller.

FIG. 4 is a sectional view of a part of FIG. 2 taken along line IV-IV, illustrating the state in which the pressure-applying belt Fp is separated from the heating roller Fh.

Figure 5:
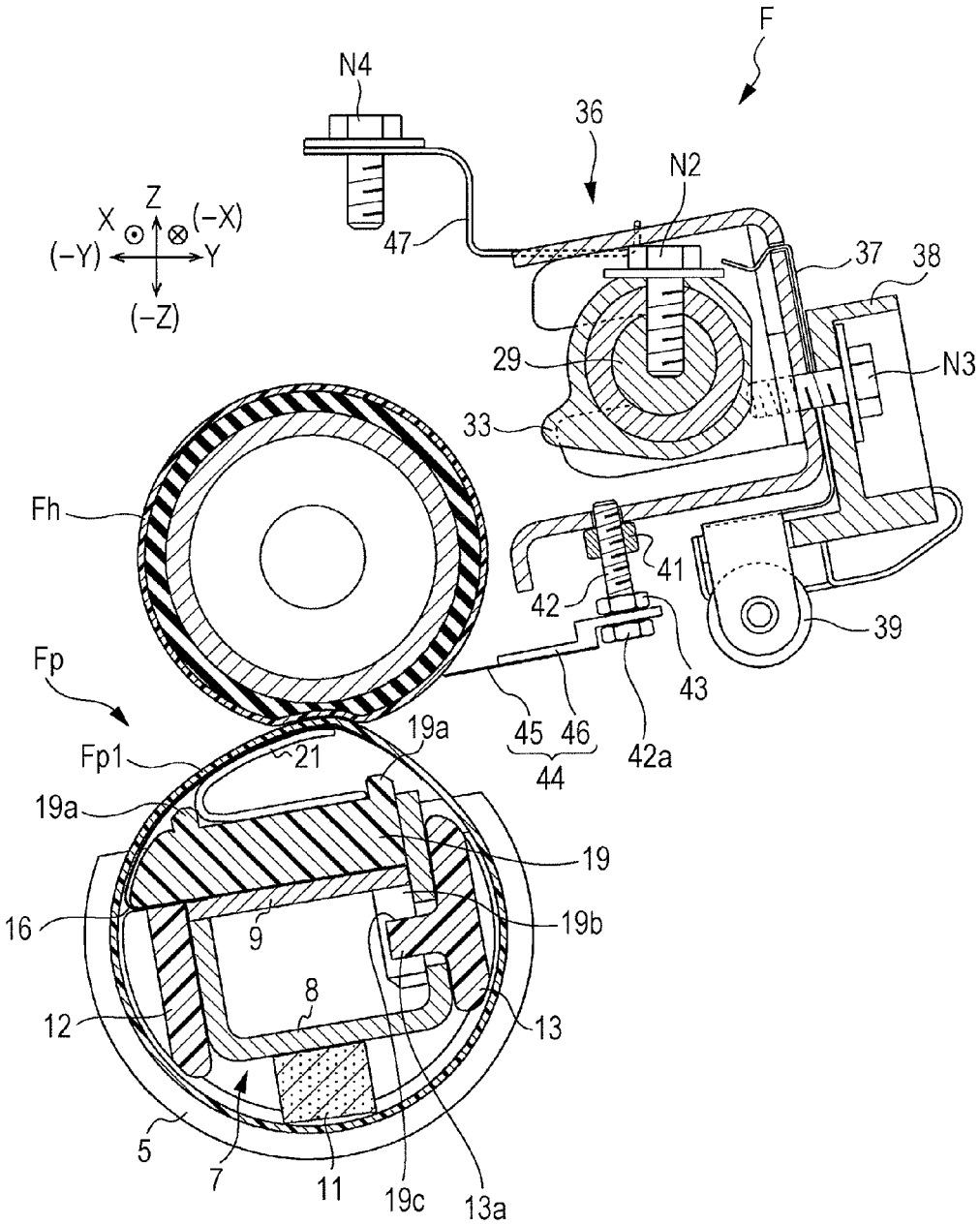
FIG. 5 is a sectional view of a part of FIG. 2 taken along line V-V, illustrating the state in which the pressure-applying belt is in contact with the heating roller and a sheet-separating member is retained at a fixing operation position.
Figure 6:
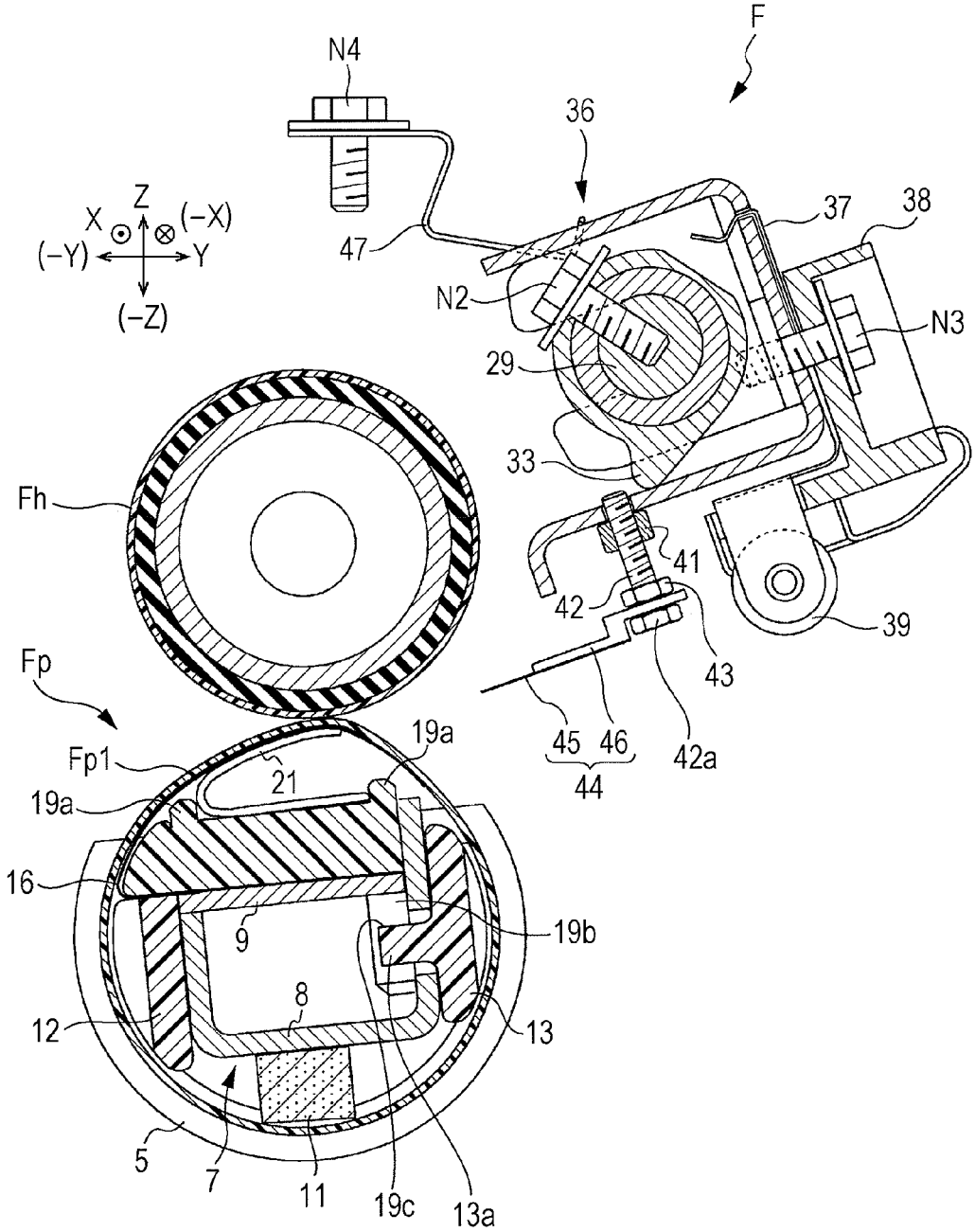
FIG. 6 is a sectional view of a part of FIG. 2 taken along line VI-VI, illustrating the state in which the pressure-applying belt is in contact with the heating roller and the sheet-separating member is retained at a separation position at which the sheet-separating member is separated from the surface of the heating roller.

FIG. 5 is a sectional view of a part of FIG. 2 taken along line V-V, illustrating the state in which the pressure-applying belt Fp is in contact with the heating roller Fh and a sheet-separating member is retained at a fixing operation position;

FIG. 6 is a sectional view of a part of FIG. 2 taken along line VI-VI, illustrating the state in which the pressure-applying belt Fp is in contact with the heating roller Fh and the sheet-separating member is retained at a separation position at which the sheet-separating member is separated from the surface of the heating roller Fh.

Referring to FIGS. 2 to 6, the fixing device F includes a front plate 1 and a rear plate 2, which are examples of support bodies, a connecting member Ta that connects top portions of the front and rear plates 1 and 2, and a connecting member Tb that connects lower left portions of the front and rear plates 1 and 2. The front and rear plates 1 and 2 serve as a pair of rotating-lever support frames. The front plate 1 and the rear plate 2, which are connected together by the connecting members Ta and Tb, are detachably fixed to a fixing frame (not shown), which is an example of a frame member, of the image forming apparatus U. The heating roller Fh is rotatably supported by the front plate 1 and the rear plate 2, and a rotating force is transmitted to the back end of the heating roller Fh from a motor (not shown), which is an example of a fixing drive unit, by a rotating-force transmitting member.

Figure 7A:
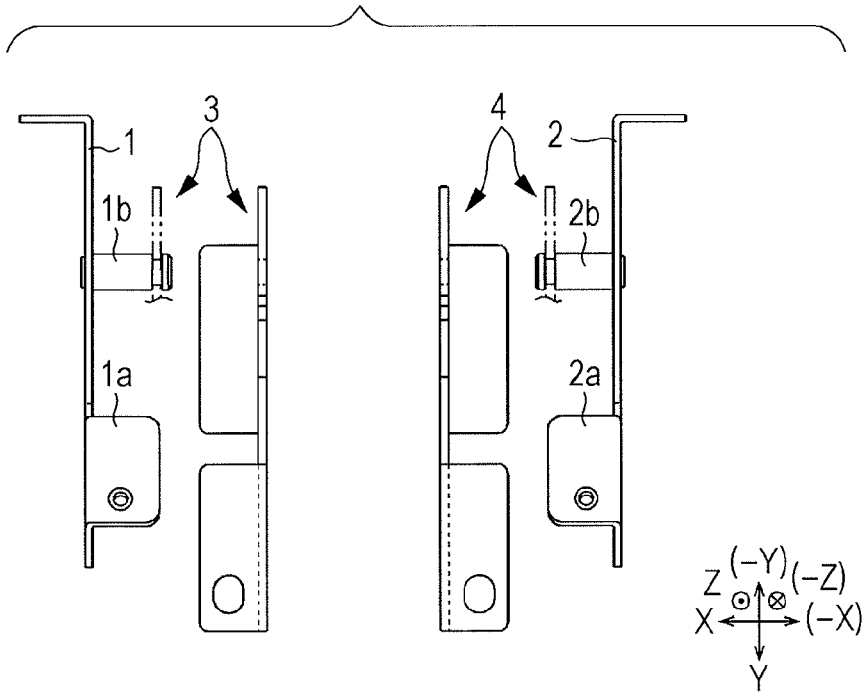
Figure 7B:
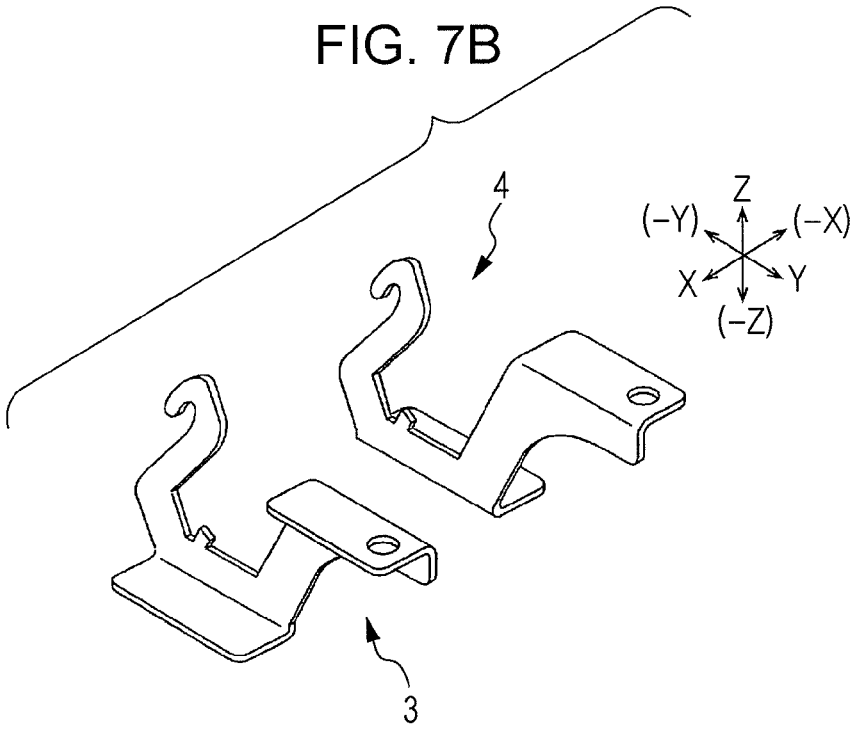

FIGS. 7A and 7B are diagrams illustrating the plates 1 and 2 and rotating levers 3 and 4 supported on the inner surfaces of the plates 1 and 2, respectively. FIG. 7A is a plan view of the plates 1 and 2 and the rotating levers 3 and 4. FIG. 7B is an enlarged perspective view of the rotating levers 3 and 4.

Referring to FIGS. 2, 3, 7A, and 7B, the front plate 1 and the rear plate 2 are provided with rod connection portions 1*a* and 2*a*, respectively, that are bent at a right angle at the top ends thereof and lever supporting shafts 1*b* and 2*b*, respectively, that project inward at the left sides of the rod connection portions 1*a* and 2*a*. The rod connection portions 1*a* and 2*a* are examples of bar connection portions, and the lever supporting shafts 1*b* and 2*b* serve as a rotation center.

Referring to FIGS. 7A and 7B, the rotating levers 3 and 4, which are examples of rotating support members, are rotatably supported by the lever supporting shafts 1*b* and 2*b*, respectively.

The rotating levers 3 and 4 respectively support a front end-attachment member 5 and a rear end-attachment member 6. A belt support frame 7, which is an example of a support member, is disposed inside a film-shaped endless belt body Fp1 such that the belt support frame 7 extends in a width direction of the pressure-applying belt Fp.

The belt support frame 7 includes a frame body 8 made of metal that is J-shaped in cross section and a plate 9 that is welded to the frame body 8. The frame body 8 is an example of a support member body, and the plate 9 is an example of a plate-shaped member.

The belt support frame 7, which includes the frame body 8 that is J-shaped in cross section and the plate 9, is connected by the end-attachment members 5 and 6 to the rotating levers 3 and 4, which are respectively supported by the front plate 1 and the rear plate 2. The rotating levers 3 and 4 rotate while supporting end portions of the belt support frame 7 in the longitudinal direction thereof. Accordingly, the belt support frame 7 is moved between a pressing position at which the belt support frame 7 is near the heating roller Fh and a separation position at which the belt support frame 7 is separated from the heating roller Fh. The separation position is an example of a releasing position.

An oil absorbent member 11 made of felt or the like is bonded to the bottom surface of a central portion of the frame body 8 included in the belt support frame 7. The oil absorbent member 11 is an example of a lubricant absorbent member, and extends in the longitudinal direction, that is, the axial direction of the heating roller Fh. Belt guides 12 and 13, which are examples of band guiding members, are attached to the outer surfaces of the belt support frame 7 so as to extend along the longitudinal direction.

A sheet-shaped sliding sheet 16, which is an example of a sliding member, and a plate-shaped base 19 that extends in the front-back direction are supported on the top surface of the plate 9. Components denoted by reference numerals 3 to 16 are known components that are described in, for example, Japanese Unexamined Patent Application Publication Nos. 2002-148972 and 2002-148984, and detailed explanations thereof are thus omitted.

According to the first exemplary embodiment, upper ribs 19*a*, which are examples of pressing retainers, are formed on the top surface of the base 19 at the left and right ends thereof. The upper ribs 19*a* project upward and extend in the front-back direction. In addition, a flat-plate-shaped lower plate 19*b* is provided at the right end of the base 19. The lower plate 19*b* projects downward and extends in the front-back direction so as to extend through a right end portion of the plate 9. The lower plate 19*b* has positioning holes 19*c* that are formed with a space therebetween in the front-back direction. The positioning holes 19*c* are positioned by allowing positioning projections 13*a* that project from the left end surface of the right belt guide 13 to extend therethrough.

A leaf spring 21, which is an example of a pressing member, is disposed between the sliding sheet 16 and the base 19 at a position corresponding to the fixing area Q5.

In the state illustrated in FIGS. 3 and 5, the leaf spring 21 presses the pressure-applying belt Fp against the heating roller Fh from the inner side of the pressure-applying belt Fp. The leaf spring 21 has a higher rigidity than that of the heating roller Fh. Therefore, the surface of the heating roller Fh that is pressed by the leaf spring 21 is deformed into a recessed shape. Owing to this deformation, the sheet S that passes through the fixing area Q5, which is the contact area between the heating roller Fh and the pressure-applying belt Fp, may be easily separated from the surface of the heating roller Fh.

Referring to FIGS. 2 to 6, the rotating levers 3 and 4 are rotatably supported by the lever supporting shafts 1*b* and 2*b* of the plates 1 and 2, respectively. Rods 26, which are examples of bar-shaped members, are supported such that the rods 26 extend through the respective rotating levers 3 and 4 while being slidable in the axial direction thereof. Spring bearings 26*a* are provided at the bottom ends of the rods 26, and compression springs 27, which are coil springs, are arranged between the spring bearings 26*a* and the rotating levers 3 and 4. The compression springs 27 are examples of rotation supporting/urging members. The compression springs 27 constantly urge the rotating levers 3 and 4 upward.

A rotating operation shaft 29 is rotatably supported by the front plate 1 and the rear plate 2. An operation handle 31, which is an example of a rotating operation member, is fixed to the rotating operation shaft 29 at the front end thereof. A raising-and-lowering cam 32, which is an example of a raising-and-lowering member, is fixed to the rotating operation shaft 29 at each end thereof with a screw N1. Each raising-and-lowering cam 32 is provided at a position adjacent to the inner surface of the front plate 1 or the rear plate 2 to move the pressure-applying belt Fp upward and downward. The above-described components denoted by reference numerals 29 and 32 form a rotational-position adjusting member 29+32.

Referring to FIGS. 5 and 6, a separating-member moving cam 33, which is an example of a separating-member-moving eccentric member, is fixed to the rotating operation shaft 29 at a position inside each raising-and-lowering cam 32. When the operation handle 31 is in the state illustrated in FIG. 2, the raising-and-lowering cam 32 is retained at the position illustrated in FIG. 3 and the separating-member moving cam 33 is retained at the position illustrated in FIG. 5. In this state, the pressure-applying belt Fp is retained at the position where the pressure-applying belt Fp is pressed against the heating roller Fh.

When the operation handle 31 is rotated counterclockwise from the position illustrated in FIG. 2, the raising-and-lowering cam 32 is rotated from the position illustrated in FIG. 3 to the position illustrated in FIG. 4 and the separating-member moving cam 33 is rotated from the position illustrated in FIG. 5 to the position illustrated in FIG. 6. In this state, the pressure-applying belt Fp is separated from the heating roller Fh and retained at a position where the pressure-applying belt Fp is not pressed against the heating roller Fh.

Referring to FIGS. 2, 5, and 6, a separating-member support member 36, which has a horizontally oriented U-shape in cross section, is rotatably supported by the rotating operation shaft 29. A guide-roller-supporting leaf spring 37, which is an example of an urging member for supporting a guiding member, and a leaf-spring fixing member 38, which is an example of an urging-member support member, are fixed to the separating-member support member 36 with screws N3. Referring to FIGS. 5 and 6, plural guide rollers 39, which are examples of medium guiding members, are rotatably supported at the bottom end of the guide-roller-supporting leaf spring 37.

Referring to FIGS. 5 and 6, plural nuts 41, which are examples of screw-receiving members, are fixed to the bottom surface of a lower central portion of the separating-member support member 36 such that the nuts 41 are arranged with intervals therebetween in the longitudinal direction. Connecting bolts 42, which are examples of connecting screws, are screwed into the nuts 41 from below. Nuts 43, which are examples of second screw-receiving members, are fastened to the connecting bolts 42 at the top sides of heads 42*a* of the connecting bolts 42. A separating member 44 is connected to each connecting bolt 42 at the bottom end thereof. The separating member 44 includes a separating sheet 45, which is a sheet-shaped separating member, for separating the sheet S from the surface of the heating roller Fh and a plate-shaped elastic separating-sheet support plate 46 that supports the separating sheet 45. The separating sheet 45 is an example of a medium-separating member and the separating-sheet support plate 46 is an example of a separation support member. The separating-sheet support plate 46 is sandwiched between the heads 42*a* of the connecting bolts 42 and the nuts 43.

The position of the separating member 44 in the up-down direction may be adjusted by loosening the nuts 43 and rotating the connecting bolts 42, and the position of the separating member 44 in the up-down direction may be fixed by fastening the nuts 43. Thus, the connecting bolts 42 and the nuts 43 form a separating-sheet-position adjusting member 42+43 that is capable of adjusting the positions of the separating-sheet support plate 46 and the separating sheet 45 with respect to the heating roller Fh. Components denoted by reference numerals 26 to 43 are known components that are described in, for example, Japanese Unexamined Patent Application Publication Nos. 2002-148972 and 2002-148984.

Referring to FIGS. 5 and 6, when the separating-member support member 36 is rotated around the rotating operation shaft 29, the guide-roller-supporting leaf spring 37 and the leaf-spring fixing member 38, which are connected to the side surface of the central portion of the separating-member support member 36, the screws N3, the guide rollers 39, the separating member 44, etc., are also rotated around the rotating operation shaft 29 together with the separating-member support member 36. As illustrated in FIGS. 5 and 6, one end portion of a separation support leaf spring 47 is attached to each of the front plate 1 and the rear plate 2 with a screw N4. A free end of each separation supporting leaf spring 47 is retained by the separating-member support member 36 at a central portion thereof. The separating-member support member 36, which is rotatably supported by the rotating operation shaft 29, is normally retained at the position illustrated in FIGS. 3 and 5 by the separation supporting leaf spring 47. When the rotating operation shaft 29 is rotated from the position illustrated in FIG. 5 to the position illustrated in FIG. 6 and the separating-member moving cam 33 pushes the central portion of the separating-member support member 36 downward, the separating-member support member 36 is rotated counterclockwise around the rotating operation shaft 29.

Description of Leaf Spring 21 of First Exemplary Embodiment

Figure 8A:
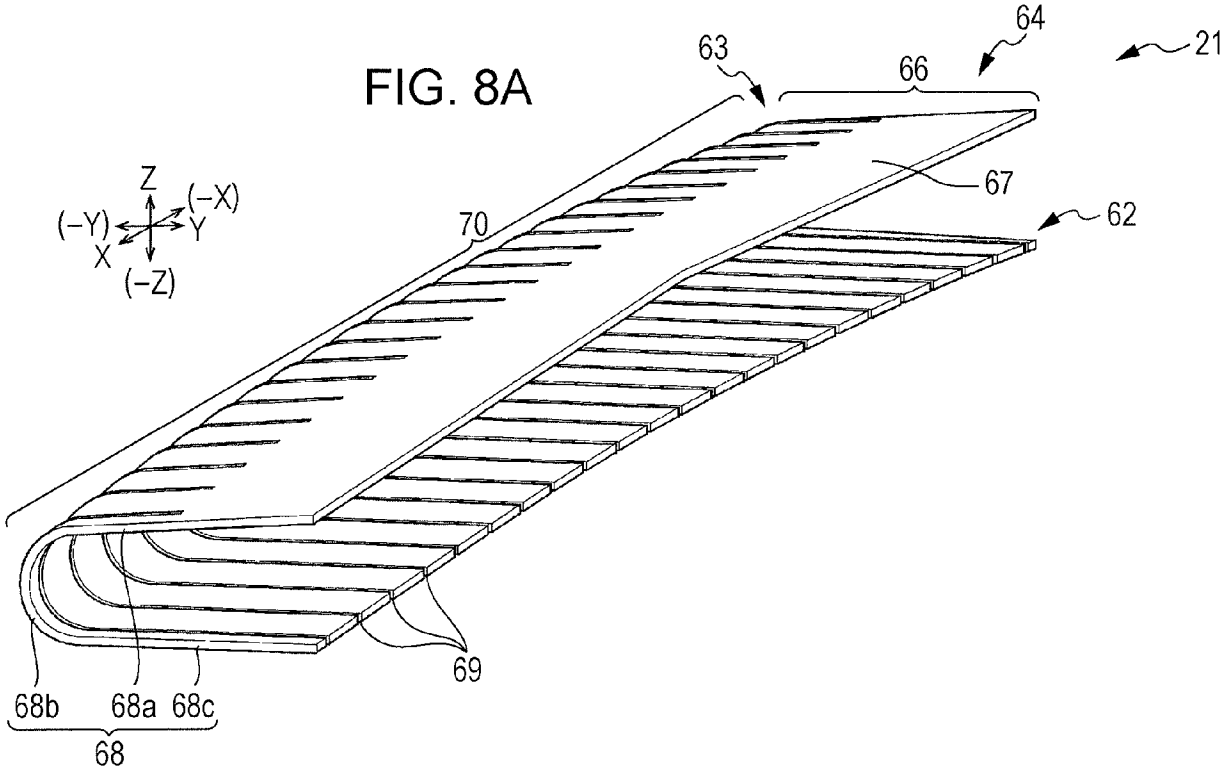
Figure 8B:
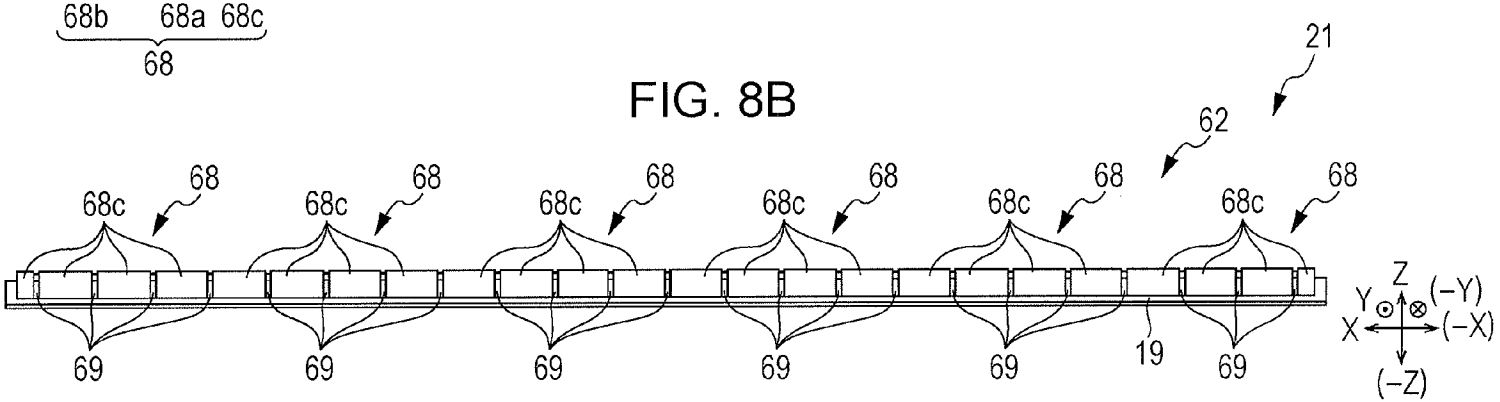

FIGS. 8A and 8B are diagrams illustrating the leaf spring 21 of the first exemplary embodiment. FIG. 8A is an enlarged perspective view of the leaf spring 21. FIG. 8B illustrates a base-end portion 62 of the leaf spring 21 supported on the base 19 as viewed in the direction from left to right.

Referring to FIG. 8A, the leaf spring 21 of the first exemplary embodiment has a U-shape with the open side facing left when viewed in the direction from back to front. The leaf spring 21 includes the base-end portion 62 that extends leftward and that is supported on the base 19, a bent portion 63 that extends from the left end of the base-end portion 62 and is bent in a horizontally oriented U-shape, and a free-end portion 64 that extends rightward from the top end of the bent portion 63 along the base-end portion 62. An urging surface 66 that urges a top end portion of the belt body Fp1 upward is formed on the free-end portion 64. The base-end portion 62 is in contact with the right upper rib 19*a* at the right end thereof, so that the base-end portion 62 is prevented from being displaced rightward.

In the first exemplary embodiment, as illustrated in FIGS. 3 and 4, the bent portion 63 is disposed between the lever supporting shafts 1*b* and 2*b*, which serve as the rotational center of the rotating levers 3 and 4. In other words, the bent portion 63 overlaps the lever supporting shafts 1*b* and 2*b* in the extending direction thereof, that is, in the front-back direction. With this configuration, when the pressure-applying belt Fp is moved to the separation position, the leaf spring 21 is rotated around the bent portion 63. Accordingly, compared to the case in which the lever supporting shafts 1*b* and 2*b*, which serve as the rotation center, are separated from the bent portion 63, an amount of elastic recovery of the free-end portion 64 may be increased. Therefore, permanent deformation, that is, yielding, of the leaf spring 21 that occurs over time may be reduced. As a result, when the pressure-applying belt Fp is moved to the pressing position, variation over time in the pressure distribution along the axial direction due to yielding of the leaf spring 21 may be reduced.

The leaf spring 21 of the first exemplary embodiment includes a flat-plate-shaped flat plate portion 67, which extends in the front-back direction, in the area between the right end of the free-end portion 64 and the central position thereof in the left-right direction. Plural strip-shaped urging portions 68 that extend leftward from the left end of the flat plate portion 67 are arranged with intervals therebetween over the entire area of the flat plate portion 67 in the front-back direction.

In the first exemplary embodiment, each urging portion 68 is formed so as to extend from the left end of the flat plate portion 67 and through the bent portion 63 and the base-end portion 62. More specifically, each urging portion 68 includes a leftward extending portion 68*a* that extends leftward from the flat plate portion 67, a curved portion 68*b* that extends from the leftward extending portion 68*a* and is curved downward, and a rightward extending portion 68*c* that extends rightward from the curved portion 68*b*.

Thus, in the first exemplary embodiment, the leaf spring 21 is formed by bending a flat-plate-shaped member into a horizontally oriented U-shape, the flat-plate-shaped member having slits 69 that extend in the left-right direction, which is a transporting direction, over an area excluding the flat plate portion 67 at the upper right end. The slits 69 are examples of air gaps, and are arranged with intervals therebetween in the front-back direction.

In the first exemplary embodiment, as illustrated in FIG. 8B, the base 19 is formed such that the height thereof in the up-down direction increases toward the center of the base 19 from the ends thereof in the front-back direction. Accordingly, as illustrated in FIG. 8A, the leaf spring 21, which is supported by the base 19 at the downstream end thereof in the transporting direction, is curved upward at the central area thereof in the front-back direction. In other words, the leaf spring 21 is shaped so as to swell upward at the central area thereof in the front-back direction.

In the first exemplary embodiment, the leaf spring 21 is formed such that the height thereof at the central area in the front-back direction is about 1.0 [mm] larger than that at the ends in the front-back direction.

In the first exemplary embodiment, the thickness of the leaf spring 21 is set to about 0.3 [mm], and the length of the flat plate portion 67 in the left-right direction is set to about 5.0 [mm]. In addition, in the first exemplary embodiment, in each urging portion 68, the length of the leftward extending portion 68*a* in the left-right direction is about 3.0 [mm], the radius of curvature of the curved portion 68*b* is about 2.0 [mm], the height of the curved portion 68*b* in the up-down direction is about 4.0 [mm], the length of the arc of the curved portion 68*b* is about 6.3 [mm], and the length of the rightward extending portion 68*c* in the left-right direction is about 8.0 [mm].

The urging portions 68 form an urging-force supplying member 70 according to the first exemplary embodiment.

Operation of First Exemplary Embodiment

In the image forming apparatus U according to the first exemplary embodiment having the above-described structure, when an image forming operation, or a job, is started, an electrostatic latent image is formed on the surface of the image carrier PR and is developed. The developed image is transferred onto the belt module BM, and then onto the sheet S that passes through the second transfer area Q4. Then, the fixing device F fixes the image in an unfixed state on the surface of the sheet S by applying heat and pressure.

At this time, in the first exemplary embodiment, the sheet S is transported through the fixing area Q5 in which the thin belt body Fp1 of the pressure-applying belt Fp is pressed against the heating roller Fh by the leaf spring 21.

Thus, in the image forming apparatus U according to the first exemplary embodiment, the leaf spring 21, which has a smaller thermal capacity than that of a thick fixing pad, is used to press the belt body Fp1 against the heating roller Fh. Thus, compared to the structure according to Japanese Unexamined Patent Application Publication No. 11-133776 (hereinafter referred to as Patent Document 1), in which a belt body is pressed against a heating roller by a fixing pad, the thermal capacity of the entire body of the pressure-applying belt Fp is reduced. Accordingly, heat dissipation from the heating roller Fh may be suppressed. As a result, power consumption required for executing the job may be reduced. In addition, the heating roller Fh may be quickly heated, so that the time required to start the image forming process may be reduced.

In addition, according to the image forming apparatus U of the first exemplary embodiment, compared to the structure according to Japanese Unexamined Patent Application Publication No. 2010-002773 (hereinafter referred to as Patent Document 2), in which a pressing roller is formed of a thick elastic layer, the thermal capacity of the entire body of the pressure-applying belt Fp is reduced. Accordingly, heat dissipation from the heating roller Fh may be suppressed, and the heating roller Fh may be quickly heated. As a result, power consumption and the time required to start the image forming process may be reduced.

Here, the case in which a medium thickness, that is, a sheet thickness of the sheet S that passes through the fixing area Q5, is not uniform in the width direction, which is the front-back direction, will be discussed. When, for example, the sheet S is an envelope, the sheet thickness corresponds not only to the total thickness of two pieces of paper at the front and back sides of the envelope but also to the total thickness of three pieces of paper in an overlapping area in which the paper is folded and glued together. Since the overlapping area extends in the longitudinal, traverse, and oblique directions over the entire body of the envelope, the sheet thickness is not uniform in the width direction over the entire area of the envelope.

Therefore, if, for example, a pressing member, such as a leaf spring or a pressing pad, has an integral structure that extends in the axial direction of the heating roller Fh, that is, in the front-back direction as in Patent Documents 1 and 2, Japanese Unexamined Patent Application Publication No. 2002-082551 (hereinafter referred to as Patent Document 3), and Japanese Patent No. 3285658 (hereinafter referred to as Patent Document 4), the heating roller Fh is locally pressed at a high pressure at positions corresponding to thick portions having a large sheet thickness in the front-back direction. Even when the sheet S is a sheet of plain printing paper, the thickness differs by an amount corresponding to the thickness of a single sheet between the areas inside and outside the edges of the sheet S in the width direction. Therefore, the heating roller Fh is locally pressed at a high pressure at positions corresponding to the edges of the sheet S.

Accordingly, there is a possibility that the heating roller Fh will be deformed as a result of being locally pressed at a high pressure at positions corresponding to the thick portions or the edges of the sheet S. More specifically, in the case where the heating roller Fh is formed of a thick base member, as in Patent Document 1, there is a possibility that wrinkles will be formed along the circumferential direction of the thick heating roller Fh. In addition, in the case where the heating roller Fh is formed of a thin base member, as in Patent Document 2, there is a possibility that buckling of the heating roller Fh will occur and the heating roller Fh will be dented.

In contrast, in the image forming apparatus U according to the first exemplary embodiment, the leaf spring 21 includes the slits 69 that extend in the left-right direction with intervals therebetween in the axial direction of the heating roller Fh. Accordingly, each urging portion 68 is capable of being elastically deformed independently of the other urging portions 68. Therefore, even when the sheet S like an envelope passes through the fixing area Q5, each of the urging portions 68 is elastically deformed in accordance with the sheet thickness. Accordingly, the local increase in the pressure applied to the heating roller Fh may be suppressed.

As a result, in the image forming apparatus U according to the first exemplary embodiment, compared to the structures according to Patent Documents 1 to 4 in which the pressing member is not provided with the urging portions 68, the possibility that the heating roller Fh will be locally pressed at a high pressure when the sheet S passes the heating roller Fh may be reduced. Accordingly, the possibility that the heating roller Fh will be damaged may also be reduced.

In the image forming apparatus U according to the first exemplary embodiment, the flat plate portion 67 is formed at the right end of the free-end portion 64 of the leaf spring 21, as illustrated in FIG. 8A. Therefore, in the first exemplary embodiment, the rigidity of the flat plate portion 67 that continuously extends in the front-back direction is higher than that of the urging portions 68 that are arranged with intervals therebetween in the front-back direction.

Thus, in the image forming apparatus U according to the first exemplary embodiment, although the urging portions 68 are capable of being elastically deformed independently of each other in accordance with the sheet thickness with respect to the axial direction of the fixing area Q5, the flat plate portion 67 having a high rigidity is used to urge the heating roller Fh in the urging direction. Accordingly, the surface of the heating roller Fh is deformed in a recessed shape so that the sheet S may be easily separated therefrom.

As a result, according to the first exemplary embodiment, the urging portions 68 serve to suppress the local increase in the pressure applied to the heating roller Fh in an upstream section of the fixing area Q5 in the transporting direction, and the flat plate portion 67 serves to improve the separating performance for separating the sheet S in a downstream section of the fixing area Q5.

In addition, in the image forming apparatus U according to the first exemplary embodiment, the base 19 is formed such that the height thereof increases toward the center from the ends thereof in the front-back direction. Accordingly, the leaf spring 21 is shaped so as to swell upward at the central area thereof in the front-back direction. In the structure in which the pressure-applying belt Fp is brought into contact with and separated from the heating roller Fh by the rotating levers 3 and 4 that support the belt support frame 7 at the ends thereof in the front-back direction, the pressure applied at the central area in the front-back direction is reduced owing to deformation of the pressing belt Fp caused by the reactive force from the heating roller Fh. Here, the leaf spring 21 according to the first exemplary embodiment is shaped such that the pressure applied in the central area in the front-back direction, which is the axial direction, is larger than the pressure applied at the end portions in the front-back direction. Accordingly, the reduction in pressure in the central area of the heating roller Fh in the front-back direction is reduced.

As a result, according to the image forming apparatus U of the first exemplary embodiment, unlike the structure in which the leaf spring 21 is not shaped so as to swell upward in the central area thereof in the front-back direction, the pressure distribution in the axial direction of the heating roller Fh may be adjusted.

Second Exemplary Embodiment

Figure 9:
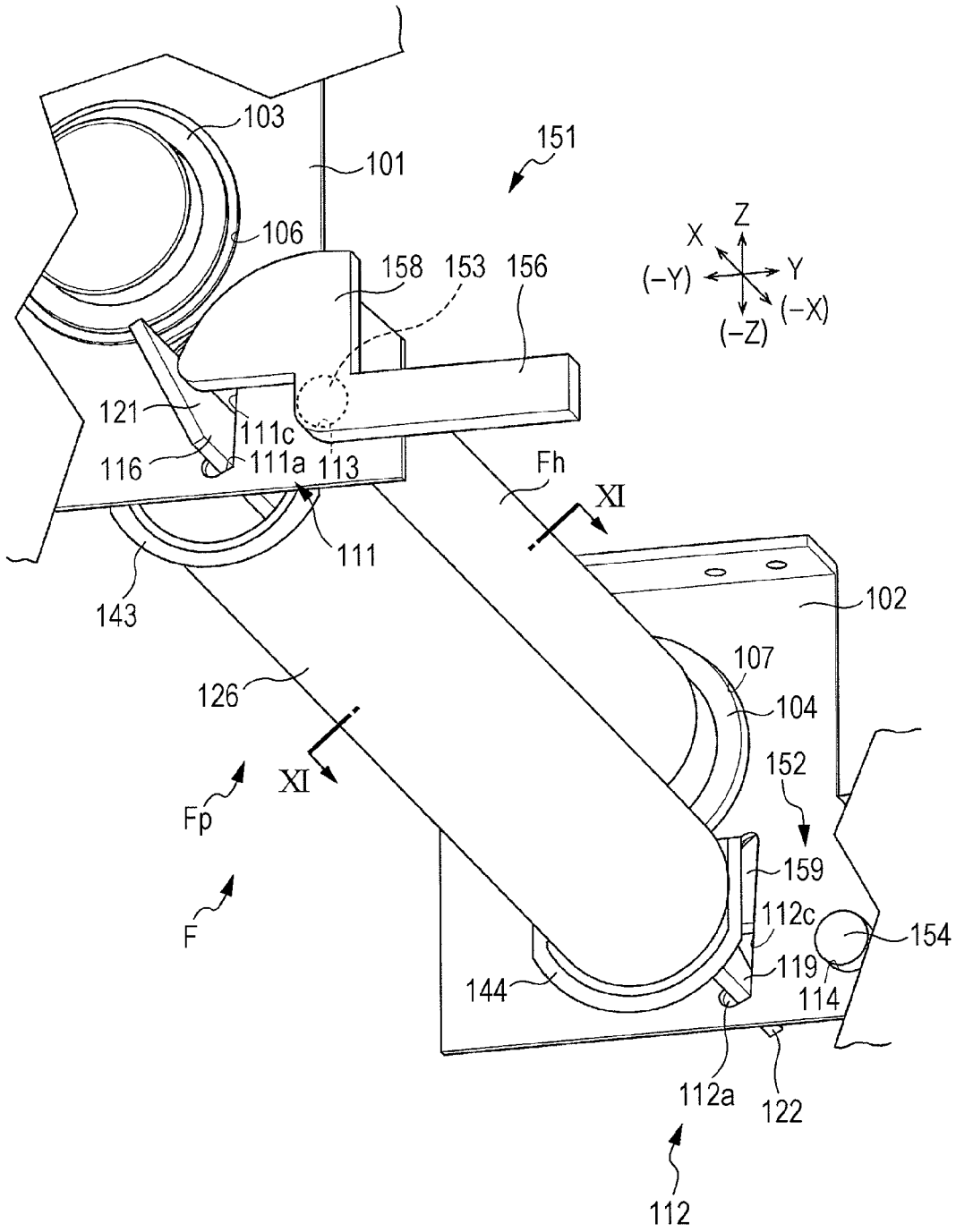
FIG. 9 is an enlarged perspective view of a fixing device according to a second exemplary embodiment.

FIG. 9 is an enlarged perspective view of a fixing device F according to a second exemplary embodiment.

Figure 10A:
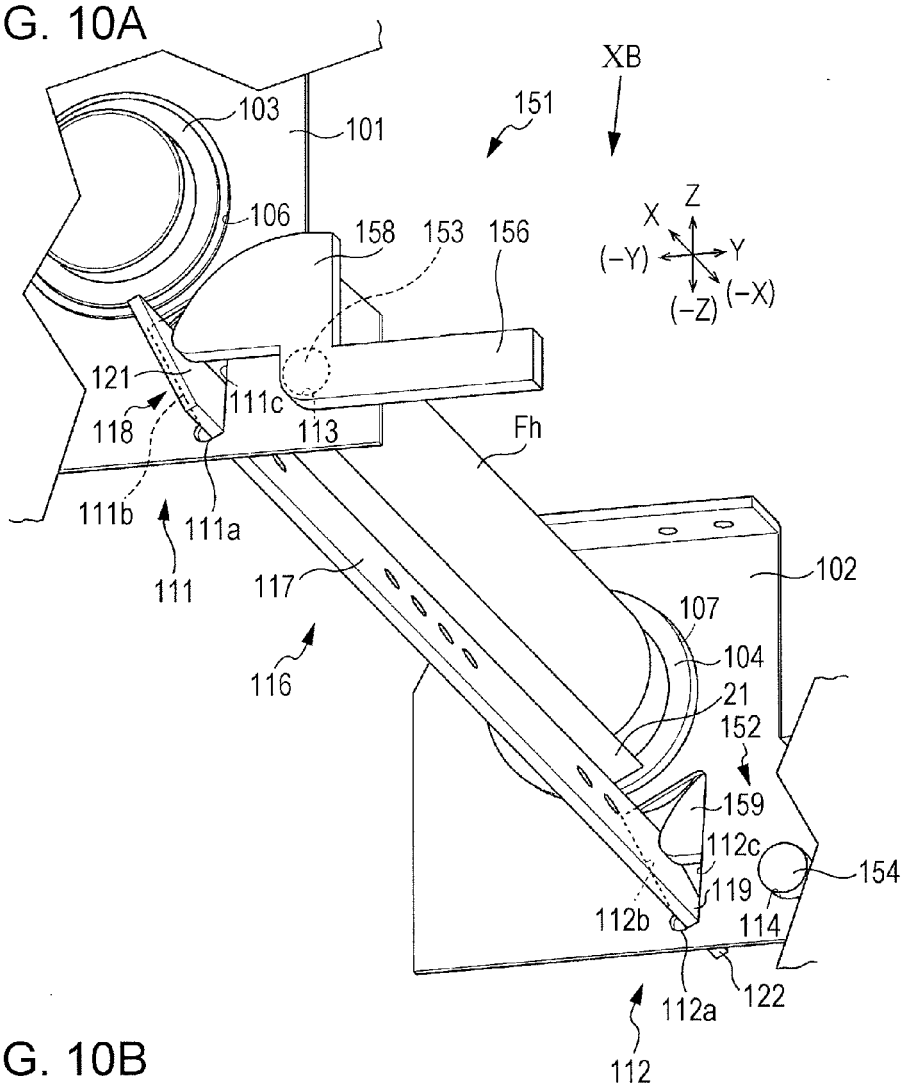
Figure 10B:
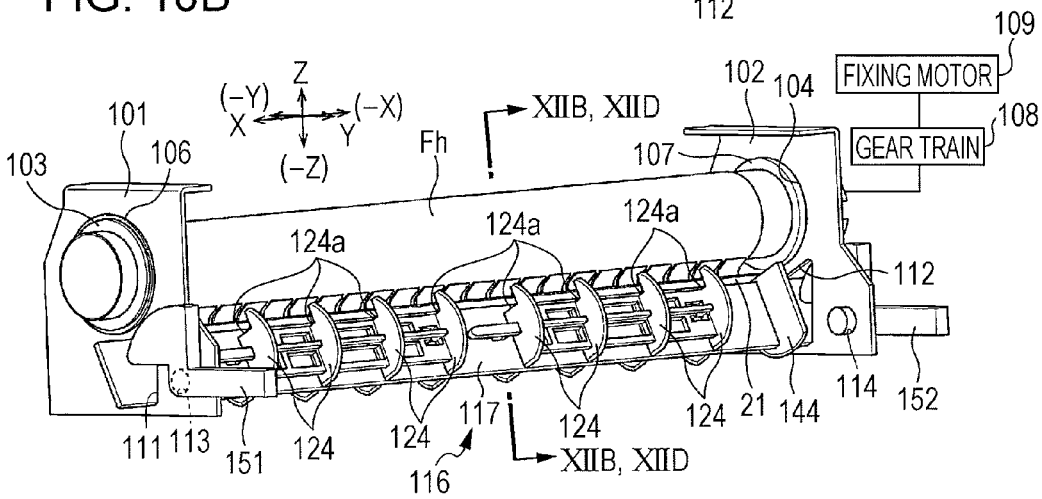

FIGS. 10A and 10B are diagrams illustrating a part of the fixing device F according to the second exemplary embodiment. FIG. 10A illustrates the state in which a belt member, end-attachment members, fins, an oil-impregnated felt, and a sliding sheet are removed from the state illustrated in FIG. 9. FIG. 10B illustrates the state in which the end-attachment members and the fins are attached, as viewed in the direction shown by arrow XB in FIG. 10A.

Figure 11:
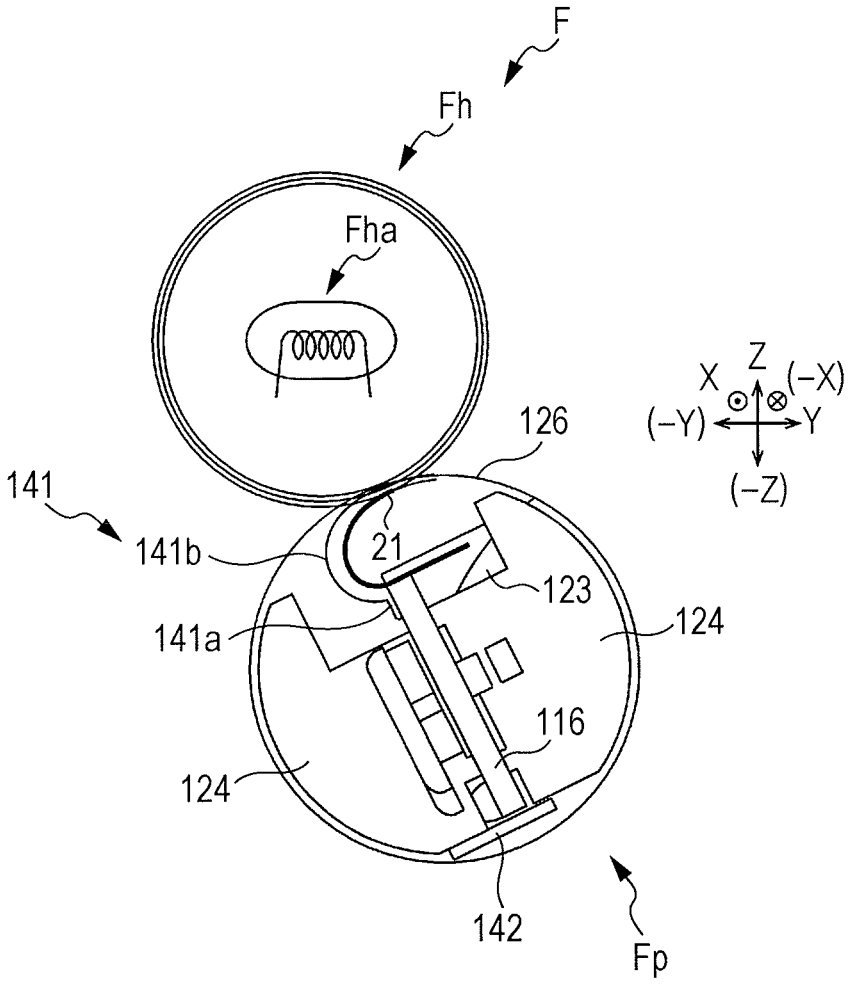
FIG. 11 is a sectional view of FIG. 9 taken along line XI-XI, illustrating a part of a heating roller and a pressure-applying belt according to the second exemplary embodiment.

FIG. 11 is a sectional view of FIG. 9 taken along line XI-XI, illustrating a part of a heating roller Fh and a pressure-applying belt Fp according to the second exemplary embodiment.

The second exemplary embodiment of the present invention will now be described. In the description of the second exemplary embodiment, components corresponding to those of the first exemplary embodiment are denoted by the same reference numerals, and detailed explanations thereof are thus omitted.

The second exemplary embodiment differs from the first exemplary embodiment in the following points, but is similar to the first exemplary embodiment in the other points.

Referring to FIGS. 9 to 11, the fixing device F according to the second exemplary embodiment includes a pair of plates, which are a front plate 101 and a rear plate 102, in place of the plates 1 and 2 in the first exemplary embodiment. The plates 101 and 102 are examples of fixing support bodies and are detachably supported by a frame (not shown) of the image forming apparatus U.

Heating-roller support portions 106 and 107, which are examples of heating support portions, are provided at upper sections of the plates 101 and 102. The heating roller Fh is rotatably supported by the heating-roller support portions 106 and 107, which are supported by heating bearings 103 and 104, which are examples of heating bearing members. A heater Fha illustrated in FIG. 11, which is an example of a heat source, is disposed in the heating roller Fh. As illustrated in FIG. 10B, a driving force is transmitted from a fixing motor 109, which is an example of a fixing drive unit, to the heating roller Fh through a gear train 108, which is an example of a driving-force transmitting member.

Holder supporting holes 111 and 112, which are examples of pressure-applying support portions, are formed below the heating-roller support portions 106 and 107, respectively. The holder supporting holes 111 and 112 according to the second exemplary embodiment have a triangular shape, and rotation centers 111*a* and 112*a* are provided at the bottom ends of the holder supporting holes 111 and 112, respectively. The holder supporting holes 111 and 112 have left edges 111*b* and 112*b* that extend toward the upper left from the rotation centers 111*a* and 112*a*, respectively, and right edges 111*c* and 112*c* that extend upward from the rotation centers 111*a* and 112*a*, respectively. The left edges 111*b* and 112*b* are examples of urging-side rotation restraining portions, and the right edges 111*c* and 112*c* are examples of releasing-side rotation restraining portions.

Circular lever supporting holes 113 and 114, which are examples of moving retainer portions, are formed in the plates 101 and 102 at positions on the right sides of the holder supporting holes 111 and 112.

Description of Pressure-Applying Belt Fp of Second Exemplary Embodiment

In the second exemplary embodiment, as illustrated in FIGS. 10A and 10B, a pressure-applying holder 116, which is an example of a support member, is disposed between the plates 101 and 102 so as to extend in the front-back direction.

The pressure-applying holder 116 according to the second exemplary embodiment includes a flat-plate-shaped holder body 117 that extends in the front-back direction. The holder body 117 is an example of a support member body. The holder body 117 according to the second exemplary embodiment includes supported portions 118 and 119 that extend through the holder supporting holes 111 and 112, respectively, at the ends of the holder body 117 in the front-back direction. The holder body 117 is supported such that the holder body 117 is rotatable around the rotation centers 111*a* and 112*a* between a pressing position at which the supported portions 118 and 119 are in contact with the left edges 111*b* and 112*b*, respectively, and a separating-restraining position at which the supported portions 118 and 119 are in contact with the right edges 111*c* and 112*c*, respectively.

Lever contact surfaces 121 and 122 are respectively formed at a position in front of the supported portion 118 at the front and a position behind the supported portion 119 at the back. The lever contact surfaces 121 and 122 are examples of contact portions and are disposed outside the plates 101 and 102, respectively. A flat-plate-shaped base 123 is formed on the right surface of the holder body 117 at the top end thereof. The base 123 is disposed inside the plates 101 and 102 such that the base 123 projects rightward and extends in the front-back direction.

Similar to the first exemplary embodiment, the base 123 according to the second exemplary embodiment is formed such that the height thereof in the up-down direction increases toward the center of the base 123 from the ends thereof in the front-back direction. Accordingly, similar to the first exemplary embodiment, the leaf spring 21 of the second exemplary embodiment, which is supported by the base 123 at the downstream end thereof in the transporting direction, is curved upward at the central area thereof in the front-back direction. In other words, the leaf spring 21 is shaped so as to swell upward by about 1.0 [mm] at the central area thereof in the front-back direction.

Plural flat-plate-shaped fins 124, which are examples of stabilizing plates, are supported on the holder body 117 so as to extend orthogonally to the left and right surfaces of the holder body 117. The fins 124 are arranged inside the plates 101 and 102 in the front-back direction with intervals therebetween. Referring to FIGS. 10B and 11, the fins 124 according to the second exemplary embodiment are formed in a semi-lunar shape so as to extend outward from the left and right end surfaces of the holder body 117. Cut portions 124*a* are formed in top end portions of the fins 124 so that the base 123 may be placed in the cut portions 124*a*.

A cylindrical belt body 126, which is an example of an endless band-shaped member, is disposed inside the plates 101 and 102 such that the belt body 126 extends in the front-back direction and surrounds the outer periphery of the pressure-applying holder 116.

The leaf spring 21 similar to that of the first exemplary embodiment is disposed between the pressure-applying holder 116 and the belt body 126 at a position corresponding to the fixing area Q5.

A sheet-shaped sliding sheet 141, which is an example of a sliding member, is disposed between the leaf spring 21 and the belt body 126. The sliding sheet 141 according to the second exemplary embodiment includes a supported portion 141*a* that is fixed to and supported by the holder body 117 at the top end thereof and a sandwiched portion 141*b* that extends toward the upper right from the supported portion 141*a* and is sandwiched between the inner peripheral surface of the belt body 126 and the urging surface 66 of the leaf spring 21. The surfaces of the sliding sheet 141 according to the second exemplary embodiment is made of polytetrafluoroethylene (PTFE), which is an example of a low friction material. The sliding sheet 141 serves to reduce the frictional force applied between the belt body 126 that rotates and the leaf spring 21 that is fixed, thereby reducing wear caused by friction.

Referring to FIG. 11, an oil-impregnated felt 142, which is an example of a lubricant applying member, is supported at the bottom end of the holder body 117. The oil-impregnated felt 142 extends in the front-back direction and is in contact with the inner surface of the belt body 126. The oil-impregnated felt 142 according to the second exemplary embodiment is impregnated with silicone oil, which is an example of a lubricant for reducing the frictional force. The silicone oil is applied to the inner surface of the belt body 126 that rotates.

Referring to FIGS. 9 and 10B, end-attachment members 143 and 144, which are examples of end-retaining members for the band-shaped member, are attached to the respective ends of the holder body 117 in the front-back direction. The end-attachment members 143 and 144 have a semi-lunar shape with an arc-shaped side at the bottom. According to the second exemplary embodiment, when the belt body 126 that rotates is moved in the front-back direction, the ends of the belt body 126 in the front-back direction come into contact with the inner side surfaces of the end-attachment members 143 and 144. Thus, the belt body 126 is restrained from being displaced.

Description of Operation Levers 151 and 152 of Second Exemplary Embodiment

Operation levers 151 and 152, which are examples of moving members, are disposed outside the plates 101 and 102, respectively. The operation levers 151 and 152 may be operated by the user. The operation levers 151 and 152 according to the second exemplary embodiment are formed in the shape of a thin flat plate, and are opposed to the plates 101 and 102, respectively. The operation levers 151 and 152 include rotating shafts 153 and 154, respectively, which are supported by the lever supporting holes 113 and 114 such that the operation levers 151 and 152 are rotatable around the rotating shafts 153 and 154, respectively. According to the second exemplary embodiment, the operation levers 151 and 152 respectively include rectangular flat-plate-shaped handle portions 156 and 157, which may be grasped by the user, at one end thereof. The operation levers 151 and 152 also respectively include contact portions 158 and 159, which are formed in the shape of a fan-shaped plate, at the other end thereof.

Figure 12B:
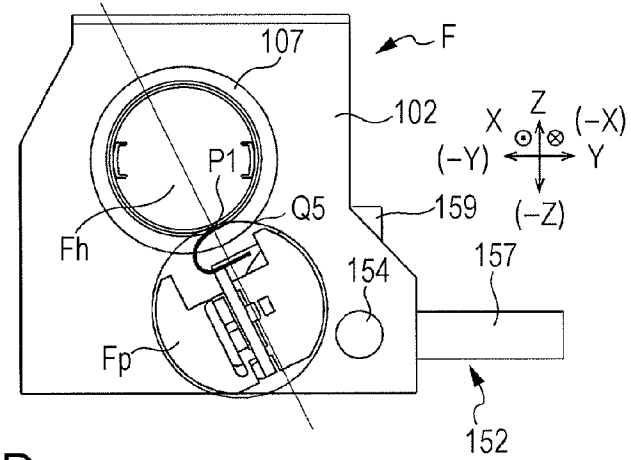
Figure 12D:
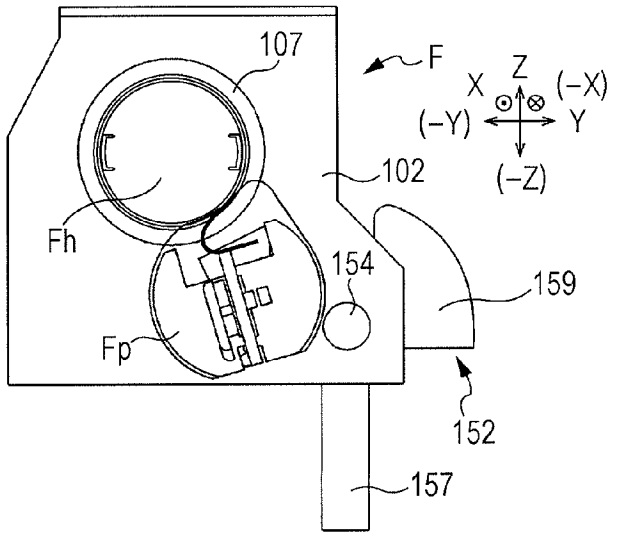
Figure 12A:
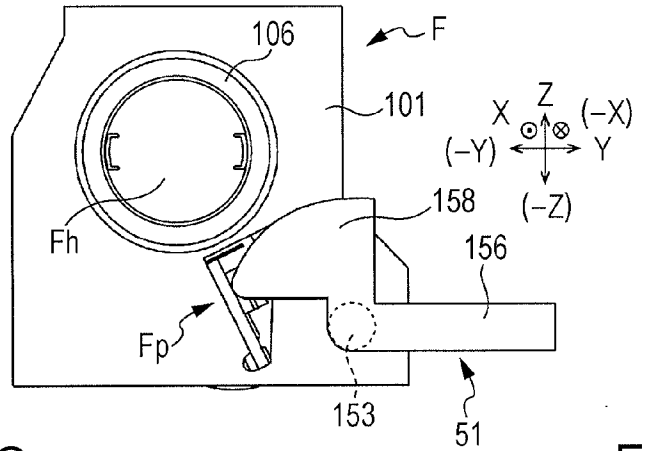
Figure 12C:
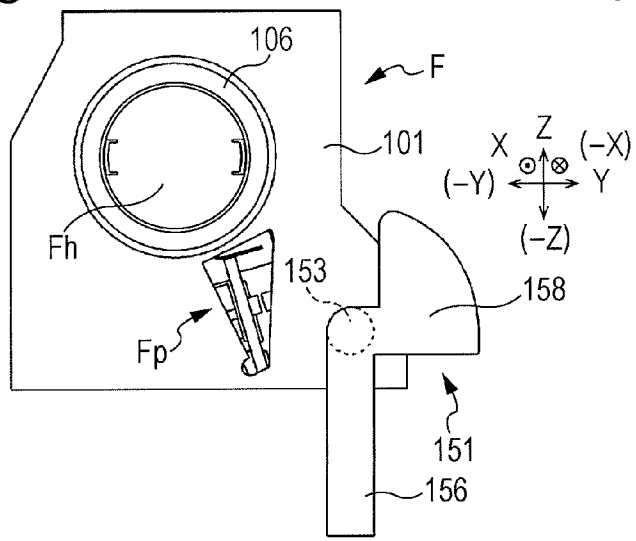

FIGS. 12A to 12D are diagrams illustrating the state of the fixing device F when the operation levers 151 and 152 according to the second exemplary embodiment are moved between a job operation position and a jam recovery operation position. FIG. 12A illustrates the state of the fixing device F when the operation levers 151 and 152 are moved to the job operation position as viewed in the direction from the front to back of the front plate 101. FIG. 12B illustrates the state of FIG. 12A in a sectional view taken along line XIIB-XIIB in FIG. 10B as viewed in the direction from front to back. FIG. 12C illustrates the state of the fixing device F when the operation levers 151 and 152 are moved to the jam recovery operation position as viewed in the direction from the front to back of the front plate 101. FIG. 12D illustrates the state of FIG. 12A in a sectional view taken along line XIID-XIID in FIG. 10B as viewed in the direction from front to back.

The operation levers 151 and 152 according to the second exemplary embodiment are supported such that the operation levers 151 and 152 are rotatable around the rotating shafts 153 and 154 between the job operation position illustrated in FIGS. 12A and 12B and the jam recovery operation position illustrated in FIGS. 12C and 12D. The job operation position is an example of a first position at which a job is executed, and the jam recovery operation position is an example of a second position at which an operation for recovering from a jam, which is a state in which a medium is jammed, is performed.

In the second exemplary embodiment, when the operation levers 151 and 152 are moved to the job operation position, the contact portions 158 and 159 come into contact with the lever contact surfaces 121 and 122, respectively. Accordingly, the holder body 117 is moved to the pressing position and is retained between the left edges 111*b* and 112*b* and the contact portions 158 and 159. In this state, as illustrated in FIG. 12B, the free-end portion 64 of the leaf spring 21 urges the belt body 126 in the urging direction, which is a direction toward the upper left, with the sliding sheet 141 interposed therebetween. Accordingly, the outer peripheral surface of the belt body 126 is pressed against the heating roller Fh. In this state, the direction shown by arrow Yb, which is the direction in which the base-end portion 62 urges the base 123 as a counteraction, is set to a direction toward the lower left, which includes the direction shown by arrow Yc, which is the direction in which the holder body 117 is moved from the pressing position toward the separating-restraining position.

In addition, in the second exemplary embodiment, when the operation levers 151 and 152 are moved to the jam recovery operation position, the contact portions 158 and 159 are moved away from the lever contact surfaces 121 and 122, respectively. Owing to the elastic recovery of the leaf spring 21, the base 123 is pushed by the base-end portion 62 so that the holder body 117 is rotated around the rotation centers 111*a* and 112*a* to a separation position, which is an example of a releasing position, in a direction away from the left edges 111*b* and 112*b* toward the right edges 111*c* and 112*c*. In this state, as illustrated in FIG. 12D, the free-end portion 64 is moved downstream from the fixing area Q5 in the transporting direction, and the urging force applied to the belt body 126 is reduced.

According to the second exemplary embodiment, as illustrated in FIG. 12B, in the state in which the holder body 117 is at the pressing position, a position at which the heating roller Fh is pressed against the belt body 126 in the fixing area Q5, that is, an upstream end P1 of the nip section in the transporting direction, is positioned on the right side of a straight line L1 that extends through the rotation center of the heating roller Fh and the rotation centers 111*a* and 112*a* of the holder body 117. Therefore, according to the second exemplary embodiment, as the operation levers 151 and 152 are operated so as to move the holder body 117 rightward toward the separation position, the distance between the base-end portion 62 and the free-end portion 64 increases owing to the elastic recovery of the bent portion 63 of the leaf spring 21. As a result, according to the second exemplary embodiment, an amount of elastic recovery of the leaf spring 21 that occurs when the holder body 117 is moved to the separation position may be increased. Accordingly, yielding of the leaf spring 21 may be reduced. As a result, when the pressure-applying belt Fp is moved to the pressing position, variation over time in the pressure distribution along the axial direction due to yielding of the leaf spring 21 may be reduced.

Operation of Second Exemplary Embodiment

In the image forming apparatus U according to the second exemplary embodiment having the above-described structure, when the operation levers 151 and 152 are moved between the job operation position and the jam recovery operation position as illustrated in FIGS. 12A to 12D, the holder body 117 is rotated between the pressing position and the separation position owing to the elastic recovery of the leaf spring 21.

As a result, in the image forming apparatus U according to the second exemplary embodiment, the number of components may be reduced compared to that in the first exemplary embodiment since the rotating levers 3 and 4, the compression springs 27, the raising-and-lowering cams 32, etc., may be omitted. Thus, manufacturing costs of the pressure-applying belt Fp, the fixing device F, and the image forming apparatus U may be reduced.

Other operational effects of the image forming apparatus U according to the second exemplary embodiment are similar to those of the image forming apparatus U according to the first exemplary embodiment.

Third Exemplary Embodiment

Figure 13:
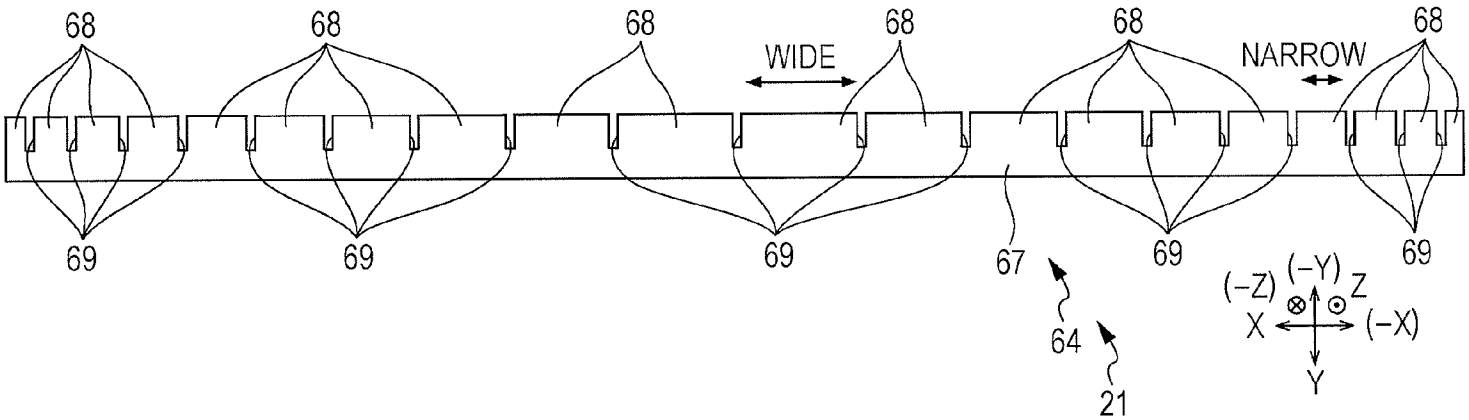
FIG. 13 is a diagram illustrating the state of a base-end portion of a leaf spring according to a third exemplary embodiment as viewed in the direction from top to bottom.

FIG. 13 is a diagram illustrating the state of a base-end portion of a leaf spring 21 according to a third exemplary embodiment as viewed in the direction from top to bottom.

The third exemplary embodiment of the present invention will now be described. In the description of the third exemplary embodiment, components corresponding to those of the second exemplary embodiment are denoted by the same reference numerals, and detailed explanations thereof are thus omitted.

The third exemplary embodiment differs from the second exemplary embodiment in the following points, but is similar to the second exemplary embodiment in the other points.

Description of Leaf Spring 21 of Third Exemplary Embodiment

Referring to FIG. 13, in the third exemplary embodiment, the base 123 is not shaped so as to swell upward at the central area thereof in the front-back direction. The leaf spring 21 is formed such that the urging width, which is the width of the strip-shaped urging portions 68 in the front-back direction, increases toward the center of the leaf spring 21 from the ends thereof in the front-back direction. In other words, in the third exemplary embodiment, the interval between the slits 69 in the leaf spring 21 increases toward the center of the leaf spring 21 from the ends thereof in the front-back direction.

Operation of Third Exemplary Embodiment

In the image forming apparatus U according to the third exemplary embodiment having the above-described structure, the urging portions 68 disposed in the central area in the front-back direction have a larger urging width and higher rigidity than those of the urging portions 68 at the ends in the front-back direction. Thus, the leaf spring 21 according to the third exemplary embodiment is shaped such that the pressure applied to the heating roller Fh in the central area in the axial direction is larger than the pressure applied at the end portions in the axial direction. Accordingly, reduction in pressure in the central area of the heating roller Fh in the axial direction is reduced. As a result, according to the image forming apparatus U of the third exemplary embodiment, unlike the case in which the urging width of the urging portions 68 in the axial direction does not increase toward the center from the ends in the front-back direction, the pressure distribution in the axial direction of the heating roller Fh may be adjusted.

Other operational effects of the image forming apparatus U according to the third exemplary embodiment are similar to those of the image forming apparatuses U according to the first and second exemplary embodiments.

Fourth Exemplary Embodiment

Figure 14:
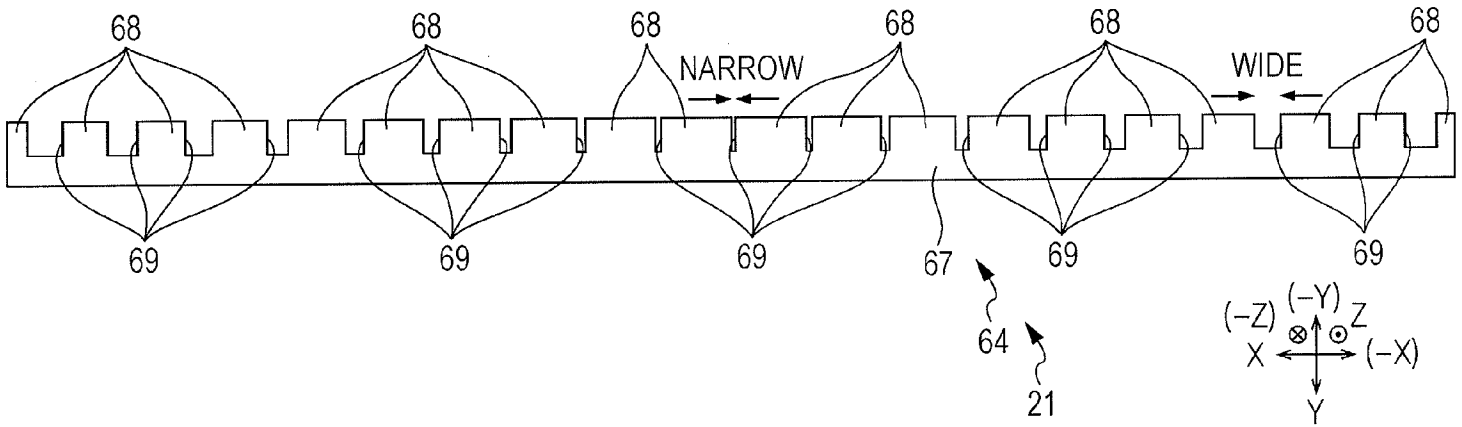
FIG. 14 is a diagram corresponding to FIG. 13 illustrating the state of a base-end portion of a leaf spring according to a fourth exemplary embodiment as viewed in the direction from top to bottom.

FIG. 14 is a diagram corresponding to FIG. 13 illustrating the state of a base-end portion of a leaf spring 21 according to a fourth exemplary embodiment as viewed in the direction from top to bottom.

The fourth exemplary embodiment of the present invention will now be described. In the description of the fourth exemplary embodiment, components corresponding to those of the third exemplary embodiment are denoted by the same reference numerals, and detailed explanations thereof are thus omitted.

The fourth exemplary embodiment differs from the third exemplary embodiment in the following points, but is similar to the third exemplary embodiment in the other points.

Description of Leaf Spring 21 of Fourth Exemplary Embodiment

Referring to FIG. 14, in the fourth exemplary embodiment, similar to the third exemplary embodiment, the base 123 is not shaped so as to swell upward at the central area thereof in the front-back direction. The leaf spring 21 is formed such that the urging interval, which is the dimension of the slits 69 in the front-back direction, decreases toward the center of the leaf spring 21 from the ends thereof in the front-back direction. In other words, in the fourth exemplary embodiment, the urging interval between the strip-shaped urging portions 68 decreases and the urging width of the urging portions 68 increases toward the center of the leaf spring 21 from the ends thereof in the front-back direction.

Operation of Fourth Exemplary Embodiment

In the image forming apparatus U according to the fourth exemplary embodiment having the above-described structure, the urging intervals of the slits 69 in the central area in the front-back direction are smaller than those of the slits 69 at the ends in the front-back direction, and the urging widths of the urging portions 68 in the central area in the front-back direction are larger than those of the urging portions 68 at the ends in the front-back direction. Accordingly, the rigidity increases toward the central area from the ends in the front-back direction. Thus, the leaf spring 21 according to the fourth exemplary embodiment is shaped such that the pressure applied to the heating roller Fh in the central area in the axial direction is larger than the pressure applied at the end portions in the axial direction. Accordingly, reduction in pressure in the central area of the heating roller Fh in the axial direction is reduced. As a result, according to the image forming apparatus U of the fourth exemplary embodiment, unlike the case in which the urging interval of the slits 69 in the axial direction does not decrease toward the center from the ends in the front-back direction, the pressure distribution in the axial direction of the heating roller Fh may be adjusted.

Other operational effects of the image forming apparatus U according to the fourth exemplary embodiment are similar to those of the image forming apparatuses U according to the first to third exemplary embodiments.

Fifth Exemplary Embodiment

Figure 15A:
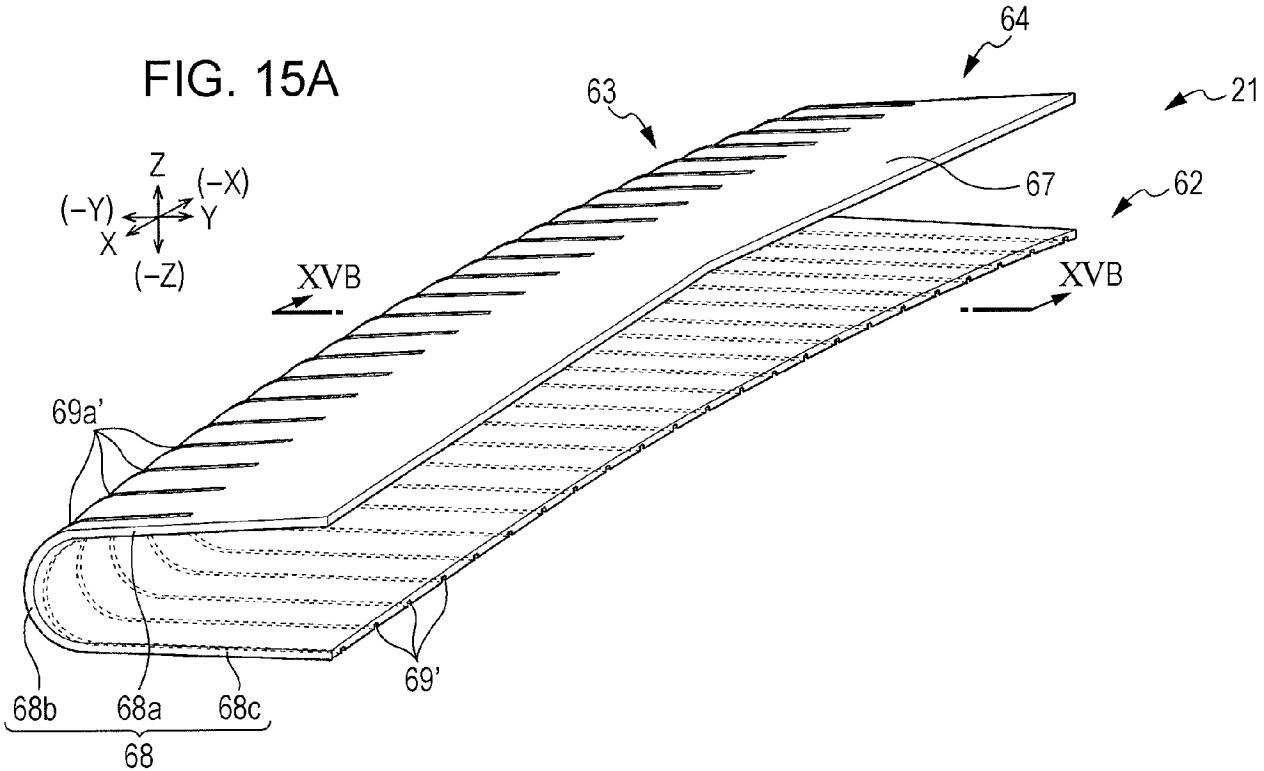
Figure 15B:
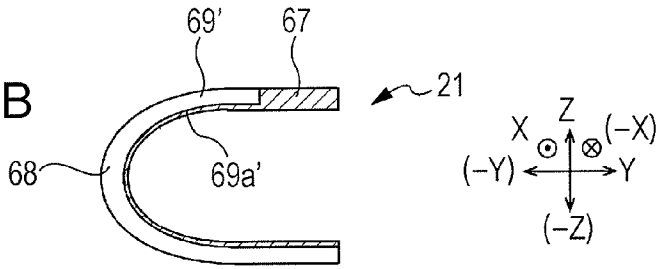

FIGS. 15A and 15B are diagrams illustrating a leaf spring 21 according to a fifth exemplary embodiment. FIG. 15A is an enlarged perspective view of the leaf spring 21 that corresponds to FIG. 8A illustrating the first exemplary embodiment. FIG. 15B is a sectional view of FIG. 15A taken along line XVB-XVB.

The fifth exemplary embodiment of the present invention will now be described. In the description of the fifth exemplary embodiment, components corresponding to those of the first exemplary embodiment are denoted by the same reference numerals, and detailed explanations thereof are thus omitted.

The fifth exemplary embodiment differs from the first exemplary embodiment in the following points, but is similar to the first exemplary embodiment in the other points.

Description of Leaf Spring 21 of Fifth Exemplary Embodiment

Referring to FIGS. 15A and 15B, in the fifth exemplary embodiment, grooves 69' that extend in the left-right direction are formed in the outer surface of the leaf spring 21, which have a bent shape, in place of the slits 69 according to the first exemplary embodiment. The grooves 69' are arranged in the front-back direction with intervals therebetween.

Thus, in the fifth exemplary embodiment, the urging portions 68 of the leaf spring 21 are sectioned from each other by the grooves 69' and are connected to each other in the front-back direction with thin-plate-shaped bottom portions 69*a*', which are examples of connecting portions.

Operation of Fifth Exemplary Embodiment

In the image forming apparatus U according to the fifth exemplary embodiment having the above-described structure, the leaf spring 21 includes the grooves 69' that extend in the left-right direction with intervals therebetween in the axial direction of the heating roller Fh. Therefore, when the sheet S like an envelope passes through the fixing area Q5, the urging portions 68 may be elastically deformed substantially independently of each other. Therefore, compared to the case in which the grooves 69' are not formed, each of the urging portions 68 may be easily elastically deformed in accordance with the sheet thickness. Accordingly, the local increase in the pressure applied to the heating roller Fh may be suppressed.

As a result, in the image forming apparatus U according to the fifth exemplary embodiment, compared to the structures according to Patent Documents 1 to 4 in which the pressing member is not provided with the grooves 69', the possibility that the heating roller Fh will be locally pressed at a high pressure when the sheet S passes the heating roller Fh may be reduced. Accordingly, the possibility that the heating roller Fh will be damaged may also be reduced. In addition, in the image forming apparatus U according to the fifth exemplary embodiment, the urging portions 68 are connected to each other with the thin bottom portions 69*a*'. Therefore, compared to the case in which the urging portions 68 are separated from each other, the leaf spring 21 may be easily handled in the process of assembling the pressure-applying belt Fp.

Other operational effects of the image forming apparatus U according to the fifth exemplary embodiment are similar to those of the image forming apparatuses U according to the first to fourth exemplary embodiments.

Sixth Exemplary Embodiment

Figures 16A, 16B, 16C:
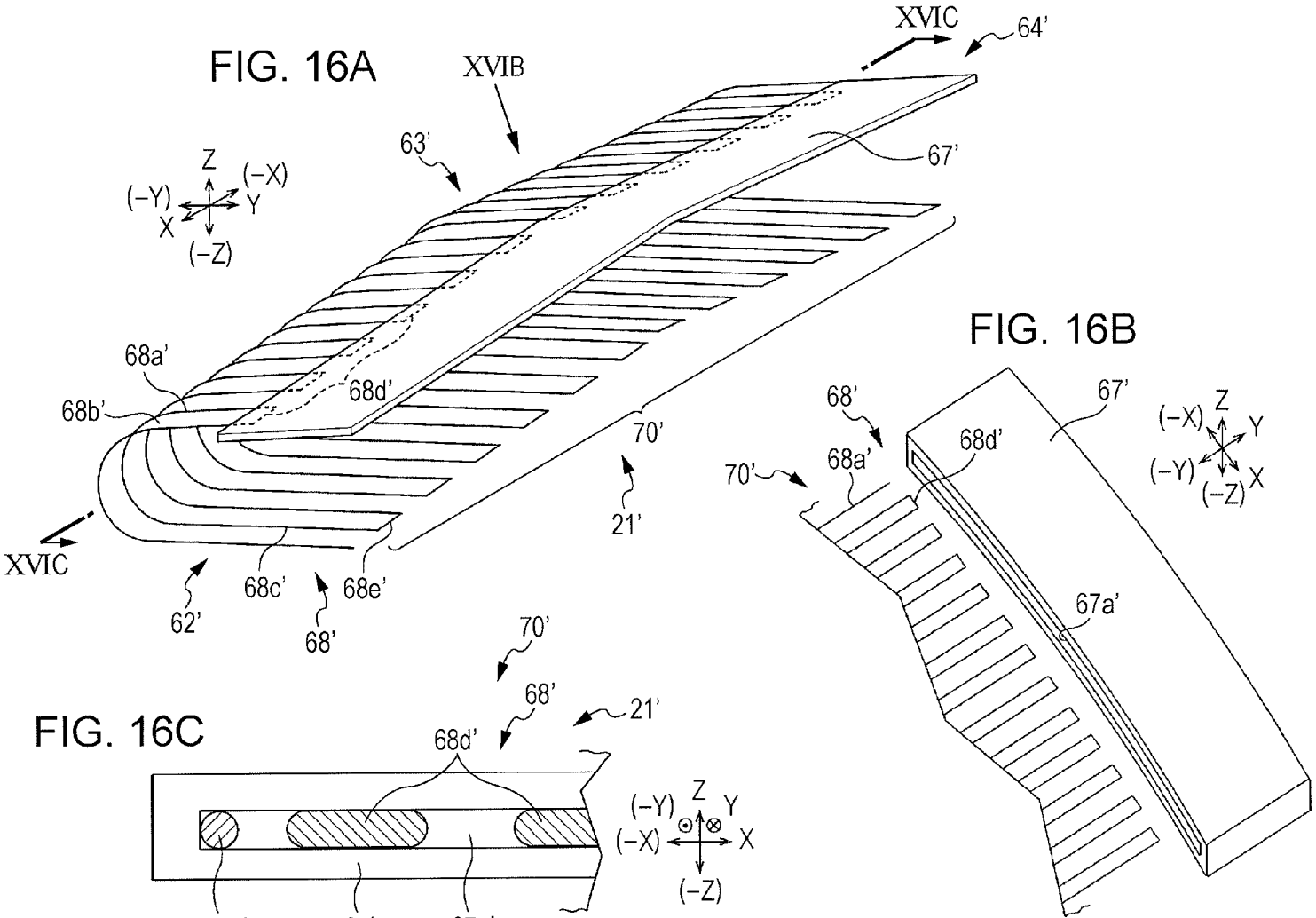

FIGS. 16A and 16B are diagrams illustrating a pressing member 21' according to a sixth exemplary embodiment. FIG. 16A is an enlarged perspective view of the pressing member 21' according to the sixth exemplary embodiment that corresponds to FIG. 8A illustrating the first exemplary embodiment. FIG. 16B is an enlarged perspective view of a flat plate portion as viewed in the direction shown by arrow XVIB in FIG. 16A. FIG. 16C is a sectional view of FIG. 16A taken along line XVIC-XVIC.

The sixth exemplary embodiment of the present invention will now be described. In the description of the sixth exemplary embodiment, components corresponding to those of the first exemplary embodiment are denoted by the same reference numerals, and detailed explanations thereof are thus omitted.

The sixth exemplary embodiment differs from the first exemplary embodiment in the following points, but is similar to the first exemplary embodiment in the other points.

Description of Pressing Member 21' of Sixth Exemplary Embodiment

Referring to FIG. 16, in the sixth exemplary embodiment, the pressing member 21' that presses the belt body Fp1 against the heating roller Fh is provided in place of the leaf spring 21 according to the first exemplary embodiment.

As illustrated in FIG. 16, different from the first exemplary embodiment in which the leaf spring 21 is formed by forming slits in a single flat plate, the pressing member 21' according to the sixth exemplary embodiment includes an urging-force supplying member 70' formed by bending a single wire and a flat plate portion 67' supported at one end of the urging-force supplying member 70'. The urging-force supplying member 70' according to the sixth exemplary embodiment is formed by bending the wire into a square wave shape, and is supported on the base 19 in a bent state, similar to the first exemplary embodiment.

The urging-force supplying member 70' includes plural linear urging portions 68' that extend in the left-right direction. Similar to the urging portions 68 according to the first exemplary embodiment, each of the urging portions 68' according to the sixth exemplary embodiment includes a leftward extending portion 68*a*', a curved portion 68*b*', and a rightward extending portion 68*c*'. The urging portions 68' include free-end connecting portions 68*d*' that connect every other pair of adjacent leftward extending portions 68*a*' at the right ends thereof and base-end connecting portions 68*e*' that connect every other pair of adjacent rightward extending portions 68*c*' at the left ends thereof.

Thus, in the pressing member 21' according to the sixth exemplary embodiment, a free-end portion 64' is formed of the flat plate portion 67', the leftward extending portions 68*a*', and the free-end connecting portions 68*d*'. In addition, a bent portion 63' is formed of the curved portions 68*b*', and a base-end portion 62' is formed of the rightward extending portions 68*c*' and the base-end connecting portions 68*e*'. In addition, air gaps that extend in the left-right direction, which is the transporting direction, are formed between the urging portions 68' with intervals therebetween in the front-back direction.

A groove-shaped fitting portion 67*a*' that extends in the front-back direction is formed in the left end surface of the flat plate portion 67'. The flat plate portion 67' is supported by the urging-force supplying member 70' such that the free-end connecting portions 68*d*' and the right end portions of the leftward extending portions 68*a*' are fitted in the fitting portion 67*a*'.

Operation of Sixth Exemplary Embodiment

In the image forming apparatus U according to the sixth exemplary embodiment having the above-described structure, the pressing member 21' includes the urging portions 68' that are arranged with intervals therebetween in the axial direction of the heating roller Fh. The urging portions 68' are capable of being elastically deformed independently of the other urging portions 68'. Therefore, even when the sheet S like an envelope passes through the fixing area Q5, each of the urging portions 68' is elastically deformed in accordance with the sheet thickness. Accordingly, the local increase in the pressure applied to the heating roller Fh may be suppressed.

As a result, in the image forming apparatus U according to the sixth exemplary embodiment, compared to the structures according to Patent Documents 1 to 4 in which the pressing member is not provided with the urging portions 68', the possibility that the heating roller Fh will be locally pressed at a high pressure when the sheet S passes the heating roller Fh may be reduced. Accordingly, the possibility that the heating roller Fh will be damaged may also be reduced.

In addition, in the image forming apparatus U according to the sixth exemplary embodiment, compared to the structure in which the urging portions 68' are not formed of a single wire, the material cost of the pressing member 21', that is may be reduced and the manufacturing cost may be reduced accordingly.

Other operational effects of the image forming apparatus U according to the sixth exemplary embodiment are similar to those of the image forming apparatuses U according to the first to fifth exemplary embodiments.

Modifications

Although exemplary embodiments of the present invention are described in detail above, the present invention is not limited to the above-described exemplary embodiments, and various modifications are possible within the scope of the present invention defined by the claims. Modifications (H01) to (H17) of the present invention will now be described.

(H01) Although a printer is described as an example of the image forming apparatus U in the above-described exemplary embodiments, the image forming apparatus is not limited to this, and may instead be, for example, a copy machine, a facsimile machine, or a multifunction machine having the functions of these machines. In addition, the image forming apparatus is also not limited to a color image forming apparatus, and may instead be a monochrome image forming apparatus.

(H02) With regard to the heating roller Fh of the above-described exemplary embodiments, the heating roller Fh may include a thin cylindrical base member as described in, for example, Patent Document 2. In such a case, the heating roller Fh may be easily elastically deformed in the nip section and the length of the fixing area Q5 in the transporting direction may be increased.

(H03) In the above-described exemplary embodiments, the operation handle 31 and the operation levers 151 and 152 may be manually operated by the user. However, the operation handle 31 and the operation levers 151 and 152 are not limited to this, and may, instead be automatically operated by, for example, a drive motor or a solenoid. This is particularly effective in the case in which the heating roller Fh includes a thin cylindrical base member having a small thermal capacity as described in, for example, Patent Document 2. In this case, the temperature may be quickly increased before the job is started while the heating roller Fh is in a separated state and the contact area of the fixing area Q5 is small. After the temperature is increased, the drive motor or the like may be driven to set the heating roller Fh to a pressed state so that the fixing process may be performed.

(H04) In the above-described exemplary embodiments, when the belt support frame 7 or the holder body 117 is moved to the separation position, the belt body Fp1, 126 is set such that the belt body Fp1, 126 is in contact with the heating roller Fh but the pressure applied to the heating roller Fh is reduced. However, the belt support frame 7 or the holder body 117 may instead be rotated until the belt body Fp1, 126 is entirely separated from the heating roller Fh.

(H05) In the above-described exemplary embodiments, the belt body Fp1, 126 is endless band shaped. However, the belt body Fp1, 126 is not limited to this, and may instead be formed in a band shape, as in Patent Document 4, such that the belt body Fp1, 126 has upstream and downstream ends in the transporting direction in the fixing area Q5. In this case, the heating roller Fh is formed so as to slide along the belt body Fp1, 126.

(H06) In the above-described exemplary embodiments, the leaf spring 21 and the pressing member 21' are formed in a U-shape with the open side facing left when viewed in the direction from back to front, and may be used in place of a fixing pad or the like described in, for example, Patent Document 1. However, the shape of the leaf spring 21 and the pressing member 21' is not limited to this. The leaf spring 21 and the pressing member 21' may be formed in an arbitrary shape, such as a horizontally oriented L-shape when viewed in the direction from front to back, similar to the sliding sheet 16, 141, or an S-shape.

(H07) In the above-described third and fourth exemplary embodiments, the pressure distribution in the axial direction of the heating roller Fh is adjusted by increasing the rigidity of the leaf spring 21 or the like at the central area thereof in the axial direction. The rigidity is increased by increasing the urging width of the urging portions 68 or reducing the urging intervals of the slits 69 toward the center of the leaf spring 21 or the like from the ends thereof in the axial direction. However, the structure for increasing the rigidity is not limited to this. For example, the rigidity at the central area may be increased by increasing the thickness of the strip-shaped urging portions 68 or the thickness of the linear urging portions 68' toward the center from the ends in the axial direction. In addition, the pressure distribution in the axial direction of the heating roller Fh may instead be adjusted by forming the urging portions 68 in the central area in the axial direction by using a material having a larger elastic modulus than that of the material of the urging portions 68 at the ends. More specifically, the urging portions 68 in the central area in the axial direction may be formed of stainless steel, which has a large elastic modulus, and the urging portions 68 at the ends may be formed of aluminum, which has a small elastic modulus. The urging portions 68 in the central area and the urging portions 68 at the ends may be joined together by, for example, welding. Alternatively, for example, the pressure distribution in the axial direction of the heating roller Fh may be adjusted by forming the urging portions 68 and the slits 69 such that the length thereof increases toward the center from the ends in the axial direction.

(H08) In the above-described fourth exemplary embodiment, the pressure distribution in the axial direction of the heating roller Fh is adjusted by decreasing the urging interval of the slits 69 and increasing the urging width of the urging portions 68 toward the center from the ends in the axial direction. However, the pressure distribution in the axial direction of the heating roller Fh may instead be adjusted by decreasing the urging interval of the slits 69 toward the center from the ends in the axial direction without changing the urging width of the urging portions 68 in the axial direction, so that the pressing force per unit area of the belt body Fp1, 126 that is in contact with the urging surface 66 increases toward the center from the ends in the axial direction.

(H09) In the above-described fifth exemplary embodiment, the grooves 69' are formed in the outer surface of the leaf spring 21 having a bent shape and the thin-plate-shaped bottom portions 69*a*' are formed at the inner side of the leaf spring 21. However, the leaf spring 21 is not limited to this, and the grooves may be formed in the inner surface of the leaf spring 21 while the thin-plate-shaped bottom portions are formed at the outer side of the leaf spring 21. Alternatively, for example, the grooves may be formed in both the inner and outer surfaces of the leaf spring 21 and the thin-plate-shaped connecting portions may be formed at the central position of the leaf spring 21 in the thickness direction thereof.

(H010) As described in the sixth exemplary embodiment, the urging-force supplying member 70' is preferably formed of a single wire. However, the urging-force supplying member 70' may instead be formed of a number of wires that corresponds to the number of urging portions 68. In this case, the free-end connecting portions 68*d*' and the base-end connecting portions 68*e*' may be omitted, and the material cost of the urging-force supplying member 70' may be reduced accordingly.

(H011) In the sixth exemplary embodiment, the free-end connecting portions 68*d*' and the right end portions of the leftward extending portions 68*a*' are fitted to the fitting portion 67*a*' in the flat plate portion 67', so that the flat plate portion 67' is supported by the urging-force supplying member 70'. However, the free-end connecting portions 68*d*' and the right end portions of the leftward extending portions 68*a*' may instead be bonded to the bottom surface of the flat plate portion 67' at the left end thereof with an adhesive or the like so that the flat plate portion 67' is supported by the urging-force supplying member 70'.

(H012) In the above-described exemplary embodiments, the urging-force supplying member 70, 70' is structured such that the urging portions 68, 68' are capable of being elastically deformed independently of each other in accordance with the sheet thickness over the entire area in the axial direction. However, the urging-force supplying member 70, 70' is not limited to this. For example, in the case in which an envelope is caused to pass through a central area in the axial direction, the urging portions 68, 68' may be provided only in the central area in the axial direction, and be elastically deformed independently of each other in accordance with the sheet thickness only in the central area in the axial direction. Thus, the urging portions 68, 68' may be provided locally instead of over the entire area in the axial direction.

(H013) In the above-described exemplary embodiments, the flat plate portion 67, 67' having a high rigidity is provided to improve the separating performance for separating the sheet S that is transported out of the fixing area Q5. However, for example, the slits 69 or the grooves 69' may be additionally formed in the area corresponding to the flat plate portion 67, 67'. In addition, in the above-described exemplary embodiments, the separating member 44 is provided to separate the sheet S from the heating roller Fh. However, when sufficient separating performance is ensured by the flat plate portion 67, 67' or the cost is to be reduced, the separating member 44 may be omitted.

(H014) The structures of the leaf spring 21 and the pressing member 21' are not limited to those in the first to sixth exemplary embodiments, and the structures of the first to sixth exemplary embodiments may be employed in combination. For example, to adjust the pressure distribution in the axial direction of the heating roller Fh, a leaf spring 21 may be formed which has all of the structure of the first, second, fifth, and sixth exemplary embodiments in which the base 19, 123 is formed so as to swell upward at the central area in the axial direction, the structure of the third exemplary embodiment in which the urging width of the urging portions 68 increases toward the center in the axial direction, the structure of the fourth exemplary embodiment in which the urging interval of the slits 69 decreases toward the center in the axial direction, and the structure of modification (H07) in which the thickness or material of the strip-shaped urging portions 68 or the length of the slits 69 is adjusted to increase the rigidity at the central area.

(H015) In the above-described exemplary embodiments and modification (H07), the pressure distribution in the axial direction of the heating roller Fh is adjusted by increasing the pressure at the central area by forming the leaf spring 21 or the pressing member 21' such that the leaf spring 21 or the pressing member 21' swells upward at the central area in the axial direction, increasing the urging width of the urging portions 68 toward the center in the axial direction, reducing the urging interval of the slits 69 toward the center in the axial direction, or adjusting the thickness or material of the strip-shaped urging portions 68 or the length of the slits 69. However, the area in which the pressure is increased is not limited to this. For example, the above-described structure may be shifted from the central area in the axial direction to change the position at which the pressure is increased. Alternatively, the above-described structure may be additionally provided in an area other than the central area in the axial direction to add the position at which the pressure is increased. For example, in the case where images are formed on special media that have cards bonded thereon at a certain position in the width direction, the pressure distribution in the axial direction of the heating roller Fh may be adjusted such that the pressure is increased in the area corresponding to thin portions that are free from the cards and reduced in the area corresponding to thick portions including the cards.

(H016) In the above-described exemplary embodiments, the sliding sheet 16, 141 is provided to reduce the frictional force between the belt body Fp1, 126 that rotates and the pressing member 21, 21' supported in a fixed state, so that wear caused by friction may be reduced. However, the wear caused by friction may instead be reduced by plating or coating contact portions of the pressing member 21, 21' and the belt body Fp1, 126 with a low-friction material. In such a case, the number of components may be reduced by omitting the sliding sheet 16, 141.

Figure 17A:
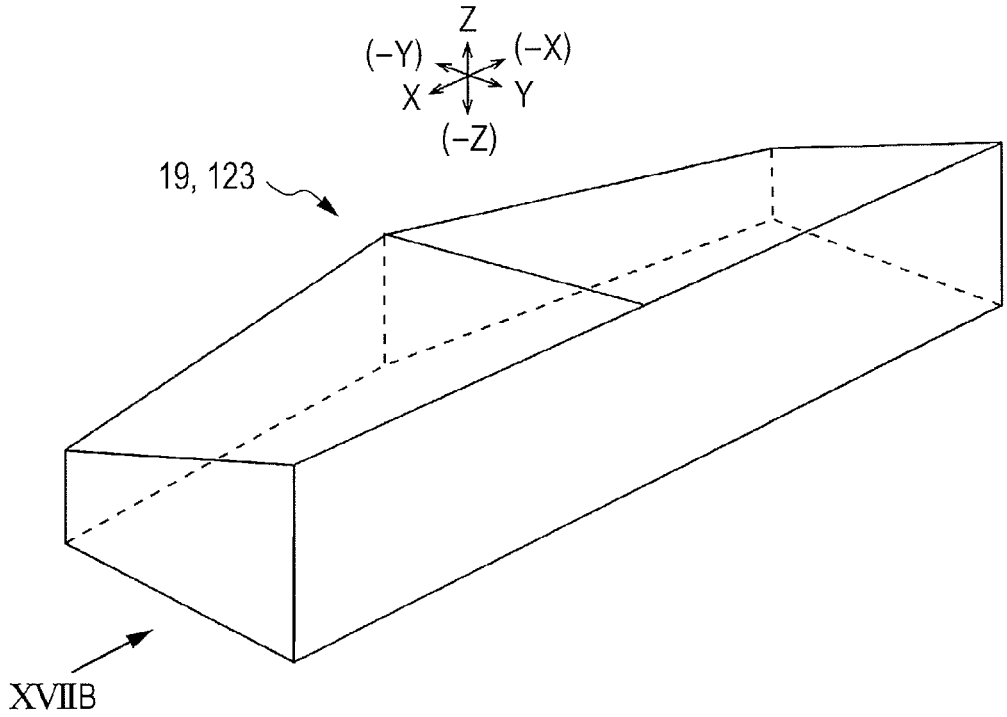
Figure 17B:
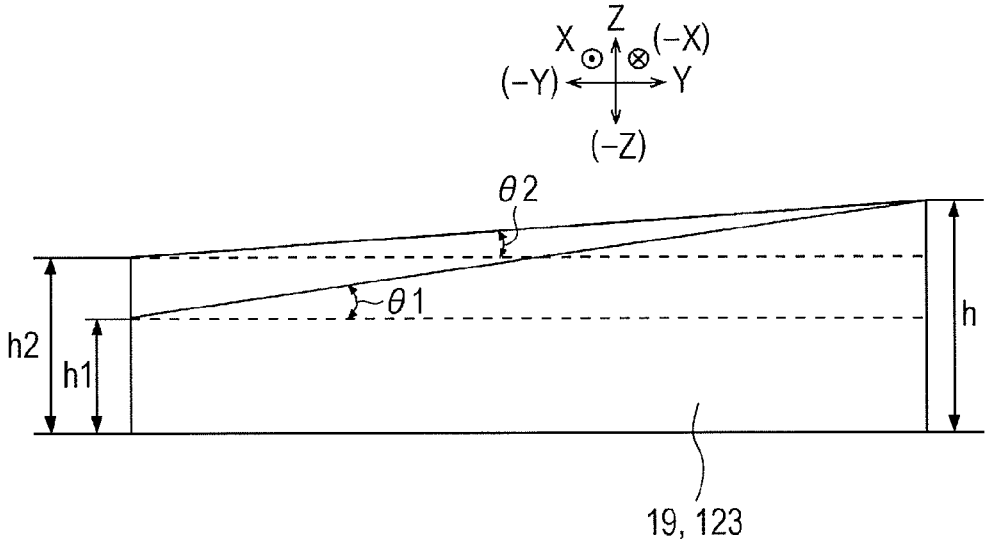

FIGS. 17A and 17B are diagrams illustrating a base 19, 123 according to a modification. FIG. 17A is an enlarged perspective view of the base 19, 123 according to the modification. FIG. 17B illustrates the base 19, 123 according to the modification as viewed in the direction shown by arrow XVIIB in FIG. 17A.

(H017) In the above-described exemplary embodiments, the top surface of the base 19, 123 is curved such that the height thereof increases toward the center from the ends in the front-back direction, thereby causing the pressing member 21, 21' to swell upward in the central area in the front-back direction. However, the base 19, 123 is not limited to this, and may instead be structured as illustrated in FIG. 17. That is, the top surface of the base 19, 123 may be inclined such that the distance to the heating roller Fh decreases toward a downstream end from an upstream end in the transporting direction and such that the inclination angle decreases toward the center from the ends in the front-back direction. In other words, as illustrated in FIG. 17B, the height h at the right end, which is the downstream end in the transporting direction, may be constant in the front-back direction, while the height at the left end, which is the upstream end, increases toward the center from the ends in the front-back direction from h1 to h2 such that the inclination angle with respect to the horizontal direction decreases from θ1 to θ2.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heating member that is rotatably supported and includes a heat source at an inner section of the heating member; and a pressure-applying member that is pressed against the heating member, wherein the pressure-applying member includes a band-shaped member that extends in a width direction of a medium that passes through a fixing area in which the band-shaped member faces the heating member, a support member that is opposed to the heating member with the band-shaped member disposed between the support member and the heating member, and a pressing member including a base-end portion that is supported by the support member and a free-end portion that extends toward the fixing area, the pressing member having a plurality of urging portions arranged with intervals therebetween in the width direction, the urging portions being elastically deformable in accordance with a thickness of the medium when the medium passes through the fixing area, the free-end portion urging the band-shaped member in an urging direction, which is toward the heating member, so that the band-shaped member is pressed against the heating member.

2. The fixing device according to claim 1, wherein air gaps are provided between the urging portions.

3. The fixing device according to claim 2, wherein the urging portions are composed of a flexible wire.

4. The fixing device according to claim 1, wherein the pressing member has connecting portions that are arranged between the urging portions and connect the urging portions to each other, the connecting portions having a thickness smaller than a thickness of the urging portions.

5. The fixing device according to claim 1, wherein the free-end portion includes a free end that is disposed at a downstream end section of the fixing area in a transporting direction in which the medium is transported, and the free-end portion is formed in a plate shape that continuously extends over the entire area of the fixing area in the width direction.

6. The fixing device according to claim 1, wherein the free-end portion is arranged in a curved state in which a central portion of the free-end portion in the width direction is closer to the heating member than end portions of the free-end portion in the width direction.

7. The fixing device according to claim 6, wherein the support member has an external shape such that a central portion of the support member in the width direction is closer to the heating member than end portions of the support member in the width direction.

8. The fixing device according to claim 1, wherein urging widths, which are dimensions of the urging portions in the width direction, are set such that the urging widths of the urging portions arranged in a central section of the pressing member in the width direction are larger than the urging widths of the urging portions arranged in end sections of the pressing member in the width direction.

9. The fixing device according to claim 1, wherein urging intervals, which are the intervals between the urging portions in the width direction, are set such that the urging intervals between the urging portions arranged in a central section of the pressing member in the width direction are smaller than the urging intervals between the urging portions arranged in end sections of the pressing member in the width direction.

10. The fixing device according to claim 1, wherein thicknesses of the urging portions are set such that the thicknesses of the urging portions arranged in a central section of the pressing member in the width direction are larger than the thicknesses of the urging portions arranged in end sections of the pressing member in the width direction.

11. The fixing device according to claim 1, wherein the urging portions arranged in a central section of the pressing member in the width direction are made of a material having a larger elastic modulus than an elastic modulus of a material of the urging portions arranged in end sections of the pressing member in the width direction.

12. The fixing device according to claim 1, further comprising:

a support body that supports the heating member such that the heating member is rotatable; and a rotating support member that supports the pressure-applying member and is supported by the support body such that the rotating support member is rotatable between a pressing position at which the pressure-applying member is pressed against the heating member and a releasing position at which the pressure-applying member is not pressed against the heating member, wherein the pressing member further includes a bent portion arranged between the base-end portion and the free-end portion such that the free-end portion is bent with respect to the base-end portion, the bent portion being disposed at a position corresponding to a rotation center of the rotating support member, wherein, when the rotating support member is moved to the pressing position, the pressing member is retained while being elastically deformed with the bent portion at the center to generate an urging force for urging the band-shaped member, and wherein, when the rotating support member is moved to the releasing position, the pressing member elastically recovers with the bent portion at the center.

13. The fixing device according to claim 1, further comprising:

a support body that supports the heating member such that the heating member is rotatable and supports the support member such that the support member is rotatable between a pressing position at which the band-shaped member is pressed against the heating member and a releasing position at which the band-shaped member is not pressed against the heating member; and a moving member that moves the support member, the moving member being supported such that the moving member is movable between a first position at which the moving member is in contact with the support member and the pressure-applying member is retained at the pressing position and a second position at which the pressure-applying member is released from the retained state and allowed to move to the releasing position, wherein, when the support member is moved to the pressing position, a direction in which the base-end portion presses the support member includes a component of a direction in which the support member is moved from the pressing position to the releasing position, and wherein, when the moving member is moved to the second position, the base-end portion pushes the support member and moves the support member to the releasing position as a result of elastic recovery of the pressing member.

14. An image forming apparatus comprising:

a transferring device that transfers an image from an image carrier that carries the image on a surface of the image carrier onto a medium; and the fixing device according to claim 1, the fixing device fixing the image that has been transferred onto the medium by applying heat and pressure.

15. A pressure-applying member that is pressed against a heating member that is rotatably supported and includes a heat source at an inner section of the heating member, the pressure-applying member comprising:

a band-shaped member that extends in a width direction of a medium that passes through a fixing area in which the band-shaped member faces the heating member;

a support member that is opposed to the heating member with the band-shaped member disposed between the support member and the heating member; and a pressing member including a base-end portion that is supported by the support member and a free-end portion that extends toward the fixing area from the base-end portion, the pressing member having a plurality of urging portions arranged with intervals therebetween in the width direction, the urging portions being elastically deformable in accordance with a thickness of the medium that has a non-uniform thickness in the width direction when the medium passes through the fixing area, the free-end portion urging the band-shaped member in an urging direction, which is toward the heating member, so that the band-shaped member is pressed against the heating member.

* * * * *